US005526015A

United States Patent [19]

Tsuboyama et al.

[11] Patent Number: 5,526,015

[45] Date of Patent: Jun. 11, 1996

[54] DISPLAY APPARATUS HAVING A DISPLAY REGION AND A NON-DISPLAY REGION

[75] Inventors: Akira Tsuboyama, Sagamihara; Akiko Ooki, Atsugi; Hiroshi Inoue, Yokohama, all of Japan

[73] Assignee: Canon Kabushiki Kaisha, Tokyo, Japan

[21] Appl. No.: 232,584

[22] Filed: Apr. 25, 1994

Related U.S. Application Data

[63] Continuation of Ser. No. 974,330, Nov. 10, 1992, abandoned, which is a continuation of Ser. No. 392,033, Aug. 10, 1989, abandoned.

[30] Foreign Application Priority Data

Aug. 17, 1988 [JP] Japan ..... 63-205067
Oct. 7, 1988 [JP] Japan ..... 63-254248

[51] Int. Cl.[6] ..... G09G 3/36

[52] U.S. Cl. ..... 345/97; 345/94

[58] Field of Search ..... 350/331 R, 331 T, 350/333, 350, 336; 345/94–97

[56] References Cited

U.S. PATENT DOCUMENTS

| | | | |
|---|---|---|---|
| 4,047,204 | 9/1977 | Gold . | |
| 4,367,924 | 1/1983 | Clark et al. | 350/334 |
| 4,563,059 | 1/1986 | Clark et al. | 350/330 |
| 4,655,561 | 4/1987 | Kanbe et al. | 350/350 |
| 4,694,349 | 9/1987 | Takeda et al. | 340/784 X |
| 4,778,260 | 10/1988 | Okada et al. . | |
| 4,827,255 | 5/1989 | Ishii | 345/148 |
| 4,902,107 | 2/1990 | Tsuboyama et al. . | |
| 4,962,376 | 10/1990 | Inoue et al. | 340/784 |
| 5,091,723 | 2/1992 | Kanno et al. | 345/97 X |

FOREIGN PATENT DOCUMENTS

| | | |
|---|---|---|
| 0223309 | 5/1987 | European Pat. Off. . |
| 0318050 | 5/1989 | European Pat. Off. . |
| 0350934 | 1/1990 | European Pat. Off. . |
| 2581209 | 10/1986 | France . |
| 2580826 | 10/1986 | France . |
| 61-059265 | 3/1986 | Japan . |

OTHER PUBLICATIONS

T. R. Touw, "Scanning System with Heirarchical Interlacing", IBM Technical Disclosure Bulletin, vol. 17, No. 8, pp. 2295–2298, Jan. 1975.

L. E. Tannas, Jr., "*Flat–Panel Display and CRTs,*" Van Nostrand Reinhold Co., 1985, p. 5.

*Applied Physics Letters,* vol. 36, No. 11, Jun. 1, 1980, pp. 899–901, Clark, N., et al., "Submicrosecond Bistable Electro–optic Switching In Liquid Crystals".

*Primary Examiner*—Ulysses Weldon

*Attorney, Agent, or Firm*—Fitzpatrick, Cella, Harper & Scinto

[57] ABSTRACT

A display apparatus includes: (a) a liquid crystal device comprising scanning electrodes, data electrodes and a ferroelectric liquid crystal disposed between the scanning electrodes and data electrodes, the scanning electrodes and data electrodes being disposed to intersect each other so as to form an electrode matrix and provide a display surface covering the electrode matrix, (b) first means for applying a scanning selection signal to the scanning electrodes and applying data signals to the data electrodes in synchronism with the scanning selection signal, and (c) second means for dividing the display surface into an effective display region and a non-display region and controlling the first means so as to apply a scanning selection signal to a scanning electrode covered by the non-display region in a shorter cycle than the application of a scanning selection signal to scanning electrodes covered by the effective display region.

12 Claims, 20 Drawing Sheets

| SCAN SIGNAL | (4M-3) FIELD F4M-3 (M=1.2.3.···) | (4M-2) FIELD F4M-2 (M=1.2.3···) | (4M-1) FIELD F4M-1 (M=1.2.3···) | 4M FIELD F4M (M=1.2.3.···) |
|---|---|---|---|---|
| S. S. SIGNAL TO (4n-3)th S. E. S4n-3 (n=1.2.3.···) | 2Vo 0 -2Vo | NO SCAN (S.N. SIGNAL) | 2Vo 0 -2Vo | NO SCAN (S.N. SIGNAL) |
| S. S. SIGNAL TO (4n-2)th S. E. S4n-2 (n=1.2.3.···) | NO SCAN (S.N. SIGNAL) | 2Vo 0 -2Vo | NO SCAN (S.N. SIGNAL) | 2Vo 0 -2Vo |
| S. S. SIGNAL TO (4n-1)th S. E. S4n-1 (n=1.2.3.···) | 2Vo 0 -2Vo | NO SCAN (S.N. SIGNAL) | 2Vo 0 -2Vo | NO SCAN (S.N. SIGNAL) |
| S. S. SIGNAL TO 4n-th S. E. S4n (n=1.2.3···) | NO SCAN (S.N. SIGNAL) | 2Vo 0 -2Vo | NO SCAN (S.N. SIGNAL) | 2Vo 0 -2Vo |
| S. N. SIGNAL | 0 | 0 | 0 | 0 |

S. S. = SCANNING SELECTION
S. N. = SCANNING NON-SELECTION
S. E. = SCANNING ELECTRODE

FIG. 14A

"W" = WHITE SIGNAL
"B" = BLACK SIGNAL
HS = HOLD SIGNAL

DISPLAY APPARATUS HAVING A DISPLAY REGION AND A NON-DISPLAY REGION

This application is a continuation of application Ser. No. 07/974,330, filed Nov. 10, 1992, now abandoned, which is a continuation of application Ser. No. 07/392,033, filed Aug. 10, 1989, now abandoned.

FIELD OF THE INVENTION AND RELATED ART

The present invention relates to a liquid crystal apparatus, particularly a display apparatus using a ferroelectric liquid crystal.

Clark and Lagerwall have disclosed a surface-stabilized bistable ferroelectric liquid crystal in Applied Physics Letters, Vol. 36, No. 11 (Jun. 1, 1980), pp. 899–901, and U.S. Pat. Nos. 4,367,924 and 4,563,059. The bistable ferroelectric liquid crystal has been realized by disposing a chiral smectic liquid crystal between a pair of substrates which are set to provide a spacing small enough to suppress the formation of a helical arrangement of liquid crystal molecules inherent to the bulk chiral smectic phase of the liquid crystal and aligning vertical molecular layers each composed of a plurality of liquid crystal molecules in one direction.

A liquid crystal apparatus comprising such a ferroelectric liquid crystal may be driven by a multiplexing drive scheme as disclosed by, e.g., U.S. Pat. No. 4,655,561 to Kanbe, et al., to provide a display with a large number of pixels.

Such a liquid crystal apparatus may be used as a display panel for a word processor, a personal computer, etc. In order to incorporate such a liquid crystal panel in a display apparatus, it is necessary to provide a housing framing the periphery of the panel. On the other hand, a liquid crystal panel has a cell structure comprising a pair of glass plates and a (ferroelectric) liquid crystal sandwiched therebetween and. It cannot generally provide a curved display surface like a CRT, so that the peripheral frame part of the housing masks a part of the display picture to an operator.

For the above reason, it has been necessary to define a part of the display surface which can be masked by the peripheral panel as a marginal non-display region and define the remaining part of the display surface which cannot be masked by the peripheral frame as an effective display region, so that the non-display region is always held in a white (or black) state and a display image is formed only in the effective display region by controlling a drive circuit.

There has been however observed a problem that if the display state of the non-display region is left to depend on the initial alignment of a ferroelectric liquid crystal, domains in a bright state and domains in a white state are co-present to result in a lower display quality.

Further, according to our experiments, in a higher region and a lower region than the effective display region of the non-display region masked by the peripheral frame, i.e., regions of the non-display region which are parallel with scanning electrodes in the effective display region and disposed outside the effective display region, it has been observed that the optical transmission state of white (or black) is fluctuated for respective scanning periods and that this is particularly pronounced at lower environmental temperatures where one scanning selection period is required to be longer to result in a lower frequency of scanning operation (frame or field operation). This fluctuation is recognized as flickering.

SUMMARY OF THE INVENTION

An object of the present invention is to provide a display apparatus having solved the above-mentioned problem, particularly suppressing the flickering due to fluctuation in optical transmission state of white (or black) in a non-display region, to provide an improved display quality.

According to the present invention, there is provided a display apparatus, comprising:

(a) a liquid crystal device comprising scanning electrodes, data electrodes and a ferroelectric liquid crystal disposed between the scanning electrodes and data electrodes, the scanning electrodes and data electrodes being disposed to intersect each other so as to form an electrode matrix and provide a display surface covering the electrode matrix, (b) first means for applying a scanning selection signal to the scanning electrodes and applying data signals to the data electrodes in synchronism with the scanning selection signal, and (c) second means for dividing the display surface into an effective display region and a non-display region and controlling the first means so as to apply a scanning selection signal to a scanning electrode covered by the non-display region in a shorter cycle than the application of a scanning selection signal to scanning electrodes covered by the effective display region.

In a preferred embodiment, the above-mentioned second means comprises a means for dividing the display surface into an effective display region covering a total of M scanning electrodes and a non-display region covering a scanning electrode and controlling the first means so as to apply a scanning selection signal to the scanning electrodes in the display region in such a manner that a scanning selection signal is applied to the scanning electrodes N electrodes apart (N: an integer of 1 or more) in one scanning operation and applied to all the M scanning electrodes covered by the display region in N+1 times of scanning operation, and to apply a scanning selection signal to the scanning electrode covered by the non-display region in a cycle during which the scanning selection signal is applied to M or less scanning electrodes, preferably M/(N+1) or less scanning electrodes, further preferably M/2(N+1) or less scanning electrodes, in the display region.

According to another aspect of the present invention, there is provided a display apparatus comprising a display apparatus, comprising:

(a) a display panel comprising scanning electrodes and data electrodes disposed to intersect the scanning electrodes so as to form a pixel at each intersection, and including a display region comprising a plurality of the pixels arranged in a plurality of rows and a plurality of columns and a marginal non-display region disposed outside the display region and constituted by a third electrode which is disposed in parallel with the scanning electrodes.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 14A–14B and 15A–15C are respectively a set of drive waveform diagrams used in the present invention.

DESCRIPTION OF THE PREFERRED EMBODIMENTS

Figure 1:
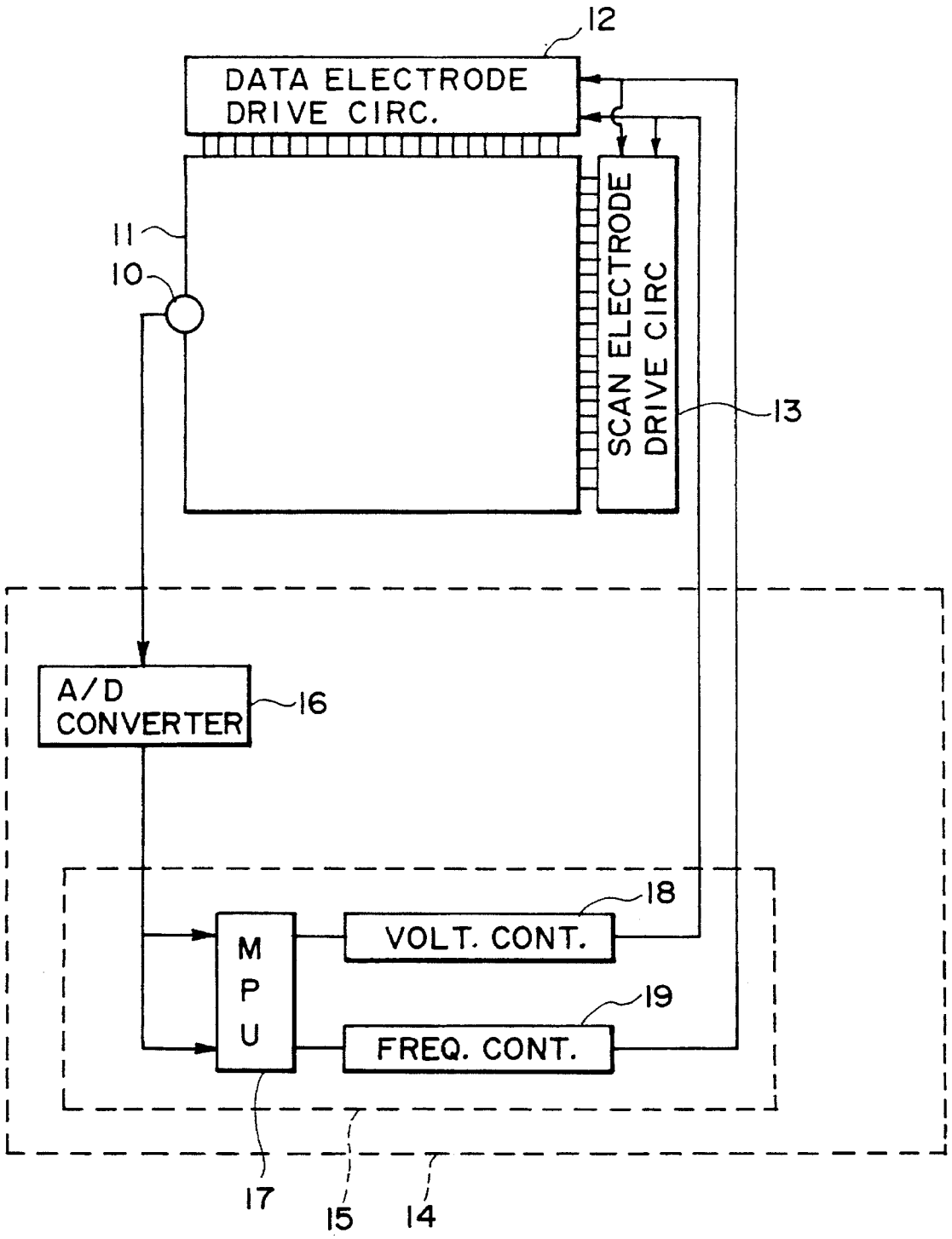
FIG. 1 is a block diagram of an apparatus according to the present invention.

FIG. 1 is a block diagram of a liquid crystal apparatus according to the present invention. Referring to FIG. 1, the liquid crystal apparatus comprises a ferroelectric liquid crystal panel 11 which in turn comprises a matrix electrode structure composed of scanning electrodes and data electrodes having a ferroelectric liquid crystal disposed between the scanning electrodes and data electrodes (detailed structure not shown), a data electrode drive circuit 12, and a scanning electrode drive circuit 13. The liquid crystal apparatus is further equipped with a temperature sensor 10 (e.g., a thermistor) for detecting an environmental temperature and outputting a voltage within a prescribed range (e.g., 2.5 V–0 V for a temperature range of 0° C.–60° C). The voltage value outputted from the temperature sensor 10 is subjected to digital conversion into a corresponding number of bits by an A/D converter 16 in a liquid crystal panel control circuit 14, and the number of bits is read and judged by an MPU (micro-processor unit) 17 in a drive waveform generation control unit 15. The resultant signal from the MPU 17 may be supplied to a voltage controller 18 and a frequency controller 19 to control output waveforms (one scanning selection period and drive voltage peak values) from the scanning electrode drive circuit 13 and the data electrode drive circuit 12.

Figure 2:
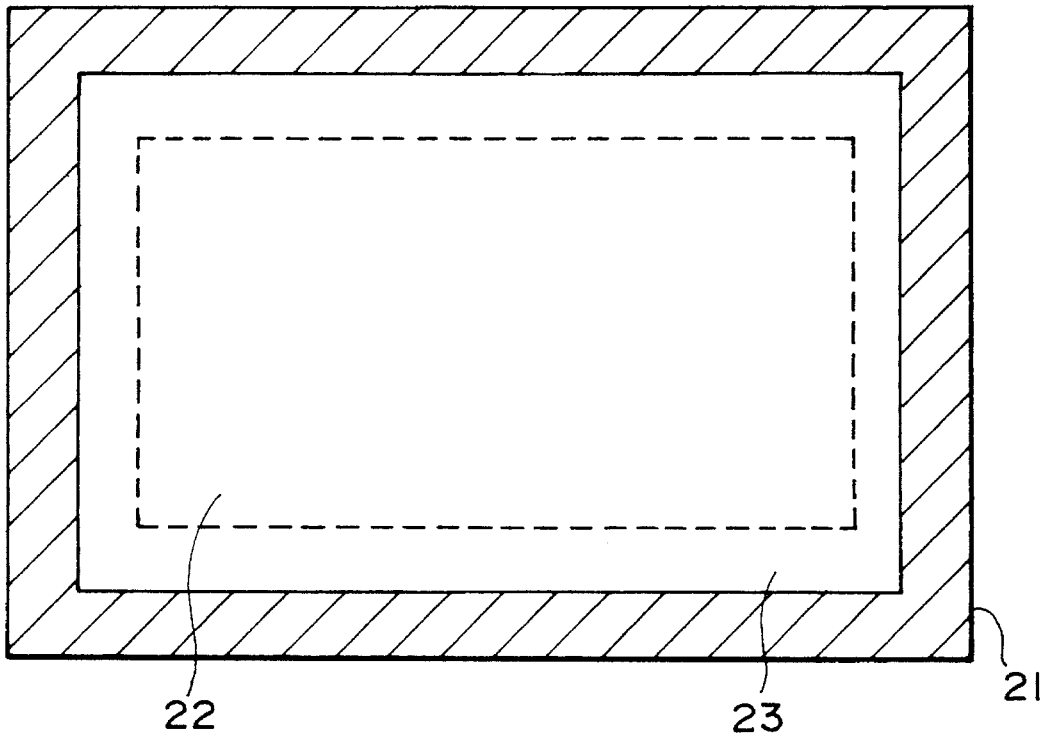
FIG. 2 is a schematic plan view of a display apparatus.

FIG. 2 is a plan view showing a display unit comprising a liquid crystal panel fixed with a peripheral frame 21 covering or masking the periphery of the liquid crystal panel. The display surface of the display panel is divided into an effective display region 22 and a non-display region 23 as described above.

Figure 3:
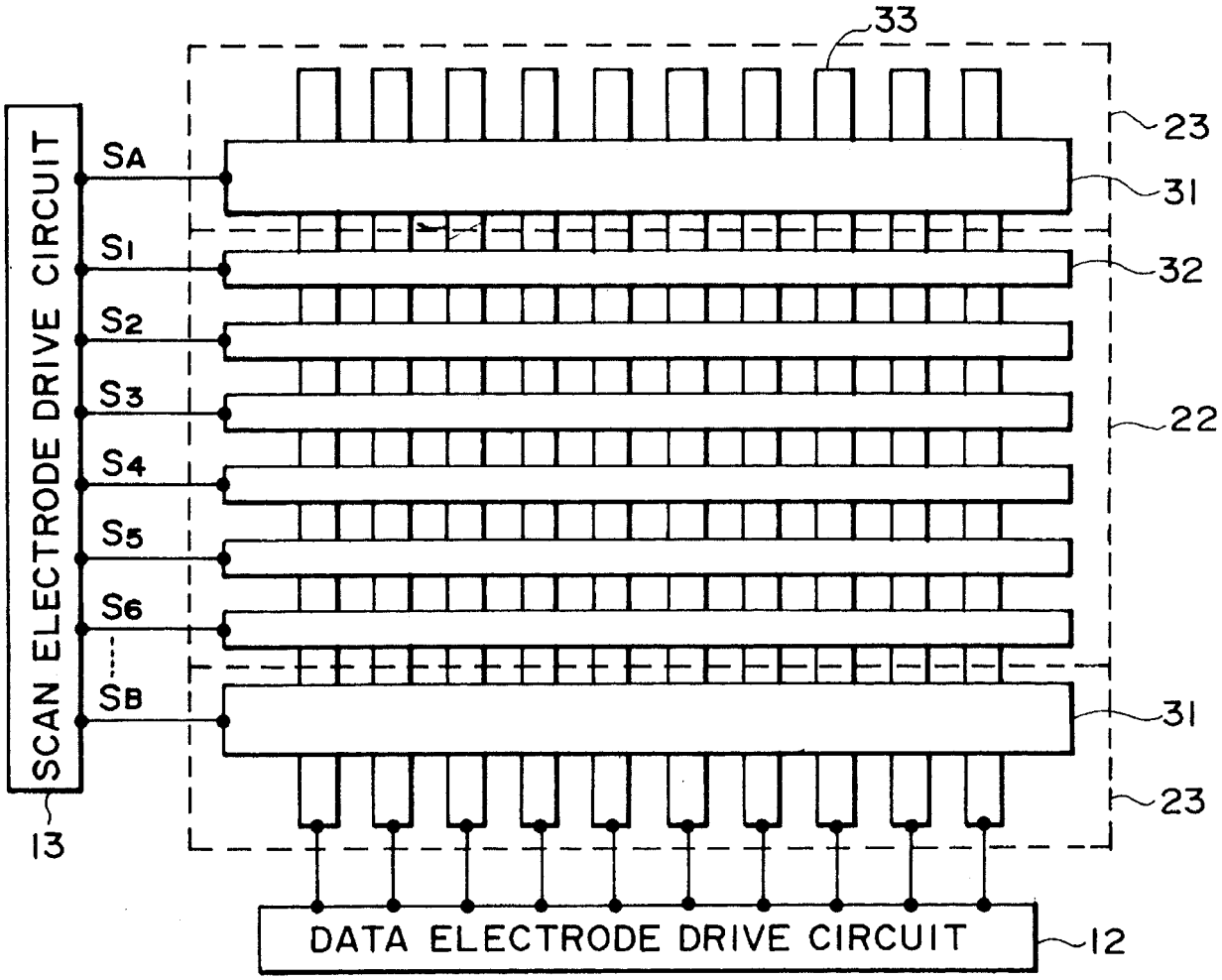
FIG. 3 is a plan view of a matrix electrode structure with drive circuits.
Figure 4A:
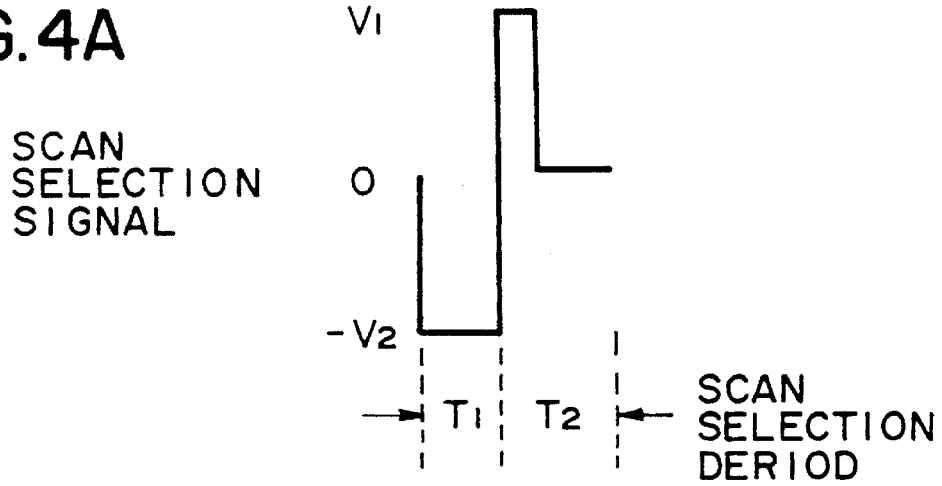
FIGS. 4A–4B are waveform diagram showing a set of driving signals used in the present invention.
Figure 4B:
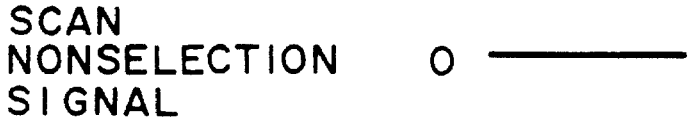
Figure 4C:
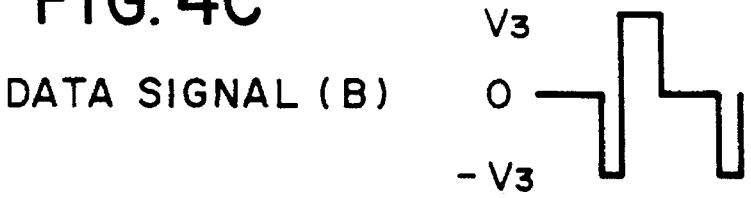
Figure 4D:
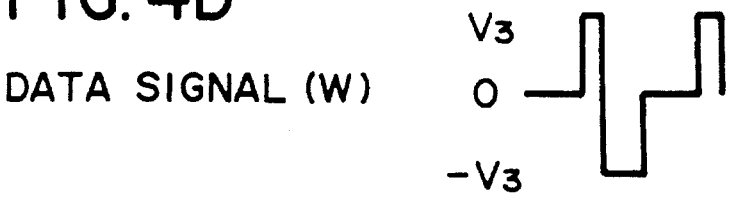

FIG. 3 is a plan view showing an electrode matrix constituting a display surface together with control circuits therefor. The electrode matrix comprises scanning electrodes including scanning electrodes 31 in the non-display regions 23 and scanning electrodes 32 in the effective display region 22 and data electrodes 33 intersecting with the scanning electrodes so as to form a pixel at each intersection. The scanning electrodes 31 and 32 are connected to the scanning electrode drive circuit 13 and the data electrodes 33 are connected to the data electrode drive circuit 12. In a preferred embodiment of the present invention, the scanning electrodes 31 in the non-display region 23 may be made broader than the scanning electrodes 32 in the effective display region 22 and may generally be formed in a width of about 1 mm–10 mm. Further, in case of equal width, the scanning electrodes may be disposed in a plurality in each non-display region 23.

FIGS. 4A–4D show a set of drive voltage signal waveforms. In one scanning selection period, a scanning selection signal comprising alternating voltages $V_1$ and $-V_2$ and a voltage of 0 (the voltages $V_1$, $-V_2$ and 0 being values defined with respect to a scanning nonselection signal as the reference level). Each data electrode is supplied with a black (B) or white (W) data signal depending on given data concerning a desired optical state. In this particular embodiment, the pixels on a scanning electrode supplied with a scanning selection signal are simultaneously erased into a black state in a period $T_1$ during one scanning selection period, and in a subsequent period $T_2$, a pixel supplied with a data signal (B) is set to a black state and a pixel supplied with a data signal (W) is set to a white state.

Figure 5:
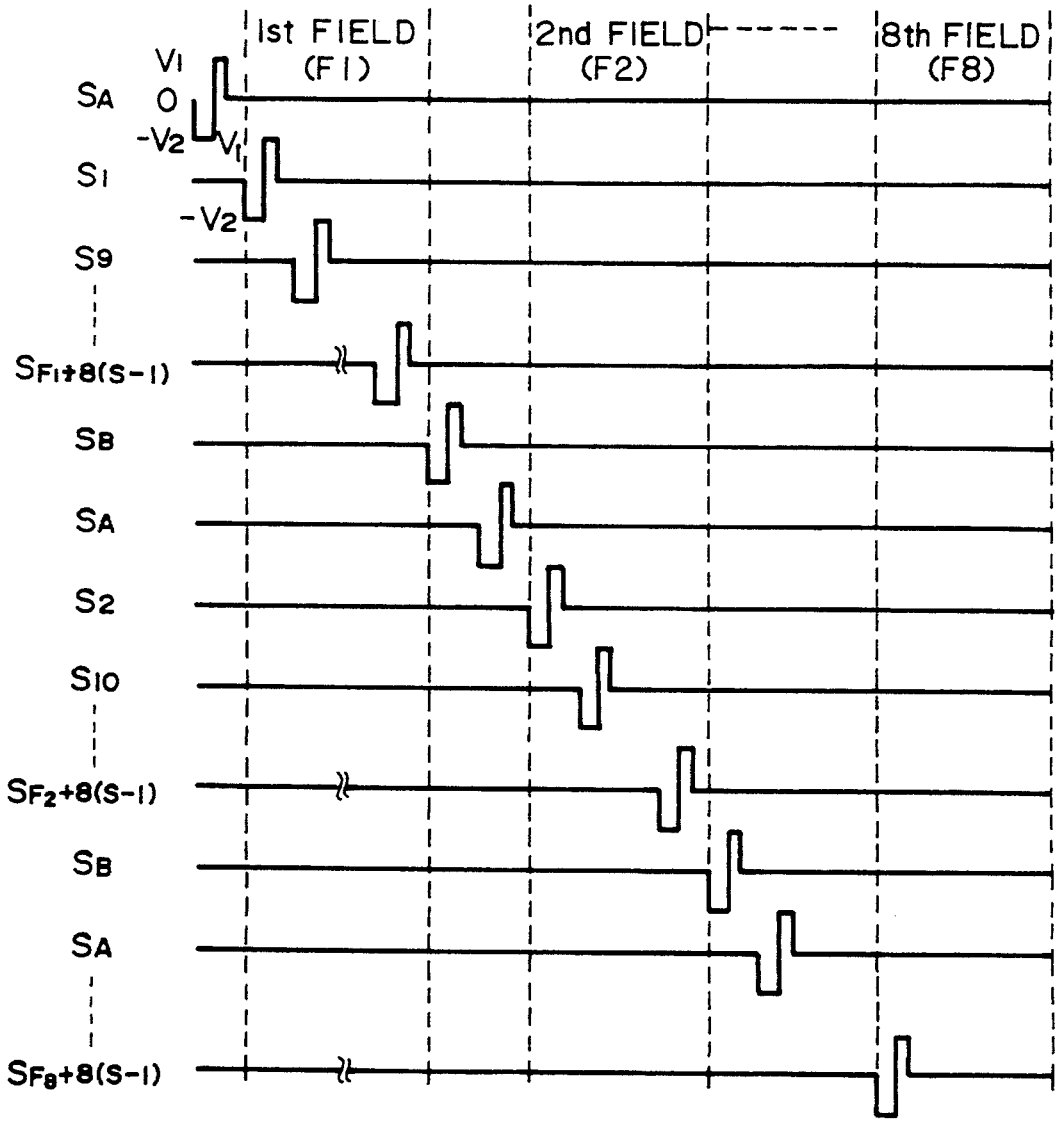
FIGS. 5 and 6 are respectively a time-serial waveform showing a set of scanning signal voltages used in the present invention.

FIG. 5 is a waveform diagram showing an example of sequence of applying a scanning selection signal to the scanning electrodes. According to the scanning sequence shown in FIG. 5, a scanning selection signal is sequentially applied to the scanning electrodes $S_1, S_2, \ldots, S_{F8+8(s-1)}$ every 8th electrode (7 electrodes apart) in one vertical scanning (field scanning) and one picture is formed through 8 times of field scanning to complete one frame scanning. In this instance, in each field scanning, the scanning selection signal is also applied to the scanning electrodes $S_A$ and $S_B$ in the non-display region. In FIG. 5, the symbols $F_1, F_2, \ldots, F_8$ each represent an ordinal number of field scanning in one frame scanning and the symbol s represents an ordinal number of scanning in one field scanning.

In a preferred embodiment of the present invention, a scanning selection signal may be applied to the scanning electrodes $S_A$ and $S_B$ in the non-display region two or more times in each field scanning. For example, it is possible to apply a scanning selection signal to the scanning electrodes $S_A$ and $S_B$ at the time when a half of each field scanning is completed and also at the time when the remaining half of each field scanning is completed.

In the driving embodiment shown in FIG. 5, in synchronism with the application of a scanning selection signal to the scanning electrodes $S_A$ and $S_B$ in the non-display region, only either one of the data signals (B) and (W) shown in FIG. 4 is applied to the data electrodes 33 by controlling the data electrode drive circuit 12. Further, in synchronism with the application of a scanning selection signal to the scanning electrodes $S_1, S_2, \ldots, S_{F8+8(s-1)}$, data signals are selectively applied to the data electrodes corresponding to given data for a desired display.

We made a series of experiments wherein the above-mentioned display operation was repeated by using a ferroelectric liquid crystal panel with the dimensions and drive conditions as shown below and the driving signal waveforms shown in FIG. 4, while applying the scanning selection signal to the scanning electrodes in the effective display region N electrodes apart (in every (N+1)-th electrode) with different number of N and effecting the above-mentioned drive to the scanning electrodes in the non-display region (i.e., as time-serially shown in FIG. 5 with different numbers of skipped scanning electrodes).

Ferroelectric Liquid Crystal Panel

Number of total scanning electrodes: 400

Scanning electrodes in the effective display region: 398

Width of each scanning electrode: 0.3 mm

Scanning electrodes in the non-display region: 2

With of each scanning electrode: 5 mm

Number of data electrodes: 640

Ferroelectric liquid crystal: "CS-1017" (trade name available from Chisso K. K.)

Peak values of drive signals, $V_1$=15 volts $-V_2$=−15 volts $\pm V_3$=±5 volts One scanning selection period: 400 μsec Temperature: 15° C.

The display states (flickering) on the panel were evaluated by a panel comprising arbitrarily selected 20 panelists (operators). The results are summarized in the following Table 1 wherein x denotes a case where 20–15 panelists recognized flickering in the non-display region; Δ, 14–6 panelists recognized flickering in the non-display region; and o, 20–15 panelists recognized no flickering in the non-display region.

TABLE 1

| N (scanning N lines apart) | 0 | 1 | 2 | 3 | 4 | 5 | 6 | 7 | 8 |
|---|---|---|---|---|---|---|---|---|---|
| Spatial frequency (Hz) | 6.3 | 12.6 | 18.9 | 25.2 | 31.5 | 37.8 | 44.1 | 50.4 | 56.9 |
| Evaluation of flickering | X | X | Δ | O | O | O | O | O | O |

From the above results, it has been found that a display substantially free from flickering in the non-display region could be realized in the cases where the scanning was effected N or more scanning electrodes apart and the scanning electrodes in the non-display region were driven in each field scanning. Further, in the case of the scanning 2 electrodes apart, no flickering was recognized either when the scanning electrodes in the non-display region were driven in each half field scanning.

Figure 6:
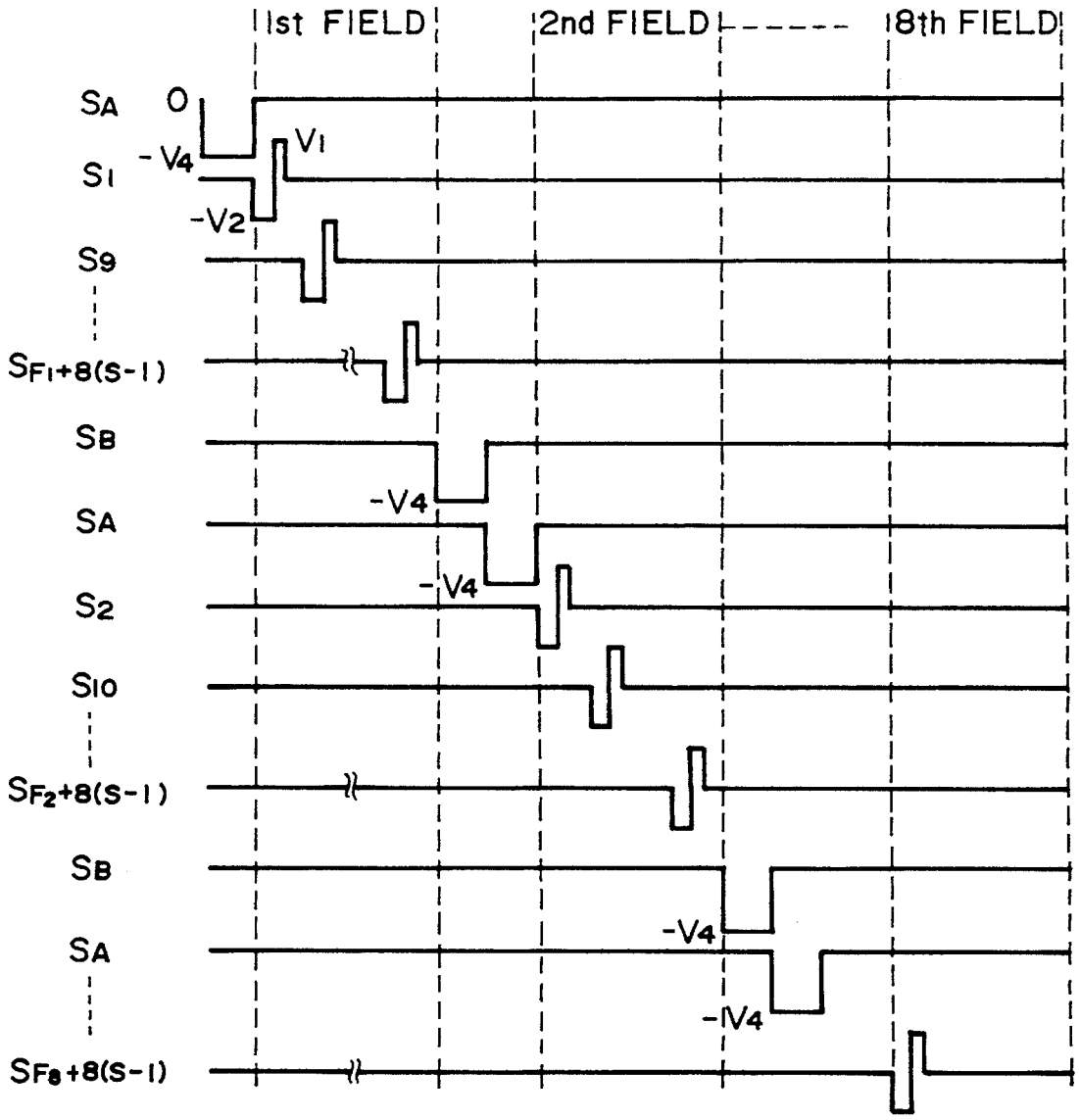

The above driving experiment was repeated by using the scanning signal waveforms time-serially shown in FIG. 6 instead of those shown in FIG. 5 with varying numbers of skipped scanning electrodes, whereby similar results as in the above embodiment were obtained. In the driving embodiment shown in FIG. 6, the scanning electrodes $S_A$ and $S_B$ in the non-display region were supplied with a non-display voltage signal pulse for providing the pixels on the scanning electrodes $S_A$ and $S_B$ simultaneously with a white (or black) state regardless of the kinds of display signals applied thereto. More specifically, the non-display voltage signal pulse in the experiment had a peak value ($-V_4$) to −20 volts and a duration of 400 μsec which was the same as one scanning selection period used for writing in the effective display region.

Figure 7:
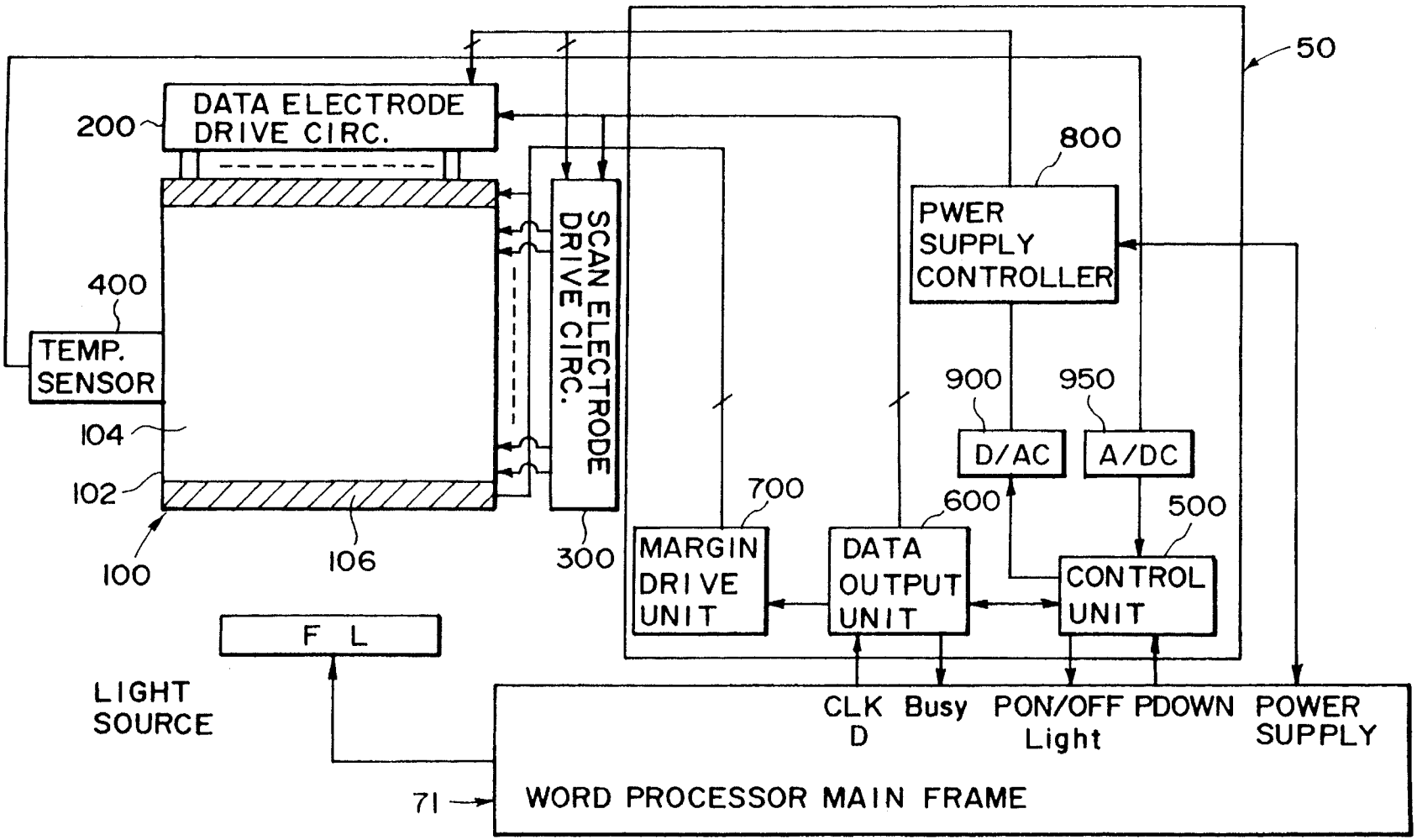
FIG. 7 is a block diagram of another embodiment of the apparatus according to the present invention.

FIG. 7 is a block diagram of another embodiment of the display apparatus according to the present invention. The display apparatus includes a display panel 100 comprising an FLC (ferroelectric liquid crystal), a word processor main frame 71 as a host apparatus functioning as a source of supplying display image data to the display panel 100, and a display control apparatus 50 for controlling the drive of the display panel 100 depending on the display data supplied from the word processor main frame 71. The display apparatus further includes a data electrode drive circuit 200 for driving data electrodes and a signal electrode drive circuit 300 for driving scanning electrodes disposed in the display panel 100 depending on drive data supplied from the display control apparatus 50, and also a temperature sensor 400 disposed at an appropriate position of the display panel 100, e.g., a position providing an average temperature.

The display panel 100 is provided with a display surface 102 including an effective display region 104 and a marginal non-display region 106 formed outside the effective display region 104 on the display surface 102. In this embodiment, electrodes are corresponding to the marginal non-display region 106 are disposed on the display panel 100 and are driven to provide the marginal region.

In display control apparatus 50, a control unit 500, which will be described in detail hereinafter with reference to FIG. 10, functions to control the transmission and receipt of various data with the display panel 100 and the word processor main frame 71. A data output unit 600, which will be described in detail with reference to FIG. 11, functions to drive the display drive circuits 200 and 300 corresponding to set data from the control unit 500 and start the control unit 500 for data setting based on display data supplied from the word processor main frame 71. A margin drive unit 700 forms the marginal non-display region 106 on the display surface 102 based on output data from the data output unit 600.

A power supply controller 800 appropriately transforms voltage signals from the word processor main frame 71 under the control of the control unit 500 to produce voltages applied to the electrodes through the display drive units 200 and 300. A D/A converter 900 is disposed between the control unit 500 and the power supply controller 800 to convert set digital data from the control unit 500 into analog data and supply the analog data to the power supply controller 800. An A/D converter 950 is disposed between the temperature sensor 400 and the control unit 500 to convert analog temperature data detected at the display panel 100.

The word processor main frame 71 is a host apparatus functioning as a source of image data supplied to the display panel 100 (through the display control apparatus 50) and can of course be replaced by another form of host apparatus, such as a computer or an image reading apparatus. In this embodiment, the word processor is one capable of supplying and receiving the following data.

Data supplied to the display control apparatus include:

D: image data, address data for designating data display positions, and signals including a horizontal synchronizing signal. Address data for designating display address (corresponding to display positions or pixels on the effective display region 104 for image data) can be outputted from a VRAM corresponding to the effective display region 104, if the host apparatus has such a VRAM. In this embodiment, the word processor main frame 71 supplies such signals in superposition with a horizontal synchronizing signal or flyback erasure signal to the data output unit 600.

CLK: transfer clock pulses for image data PD0–PD3, supplied to the data output unit 600.

PDOWN: a signal for notifying to break the power supply of the system, supplied to the control unit 500 as a non-maskable interrupting (NMI) signal.

Data supplied from the display control apparatus 50 to the word processor main frame 71 include:

P ON/OFF: status signals for notifying completion of rising and falling of the display control apparatus 50 at the time of turning-on and turning-off of the system power supply, supplied from the control unit 500.

Light: a signal for directing the ON/OFF of a light source FL combined with the display panel 100, supplied from the control unit 500.

Busy: a synchronizing signal for having the word processor main frame 71 delay the transfer of signals in order to allow the display control apparatus 50 to effect various settings at the time of start-up or display operation. In this embodiment, the word processor main frame 71 is constructed so as to be able to receive the "Busy" signal, supplied from the control unit 500 through the data output unit 600.

Figure 8:
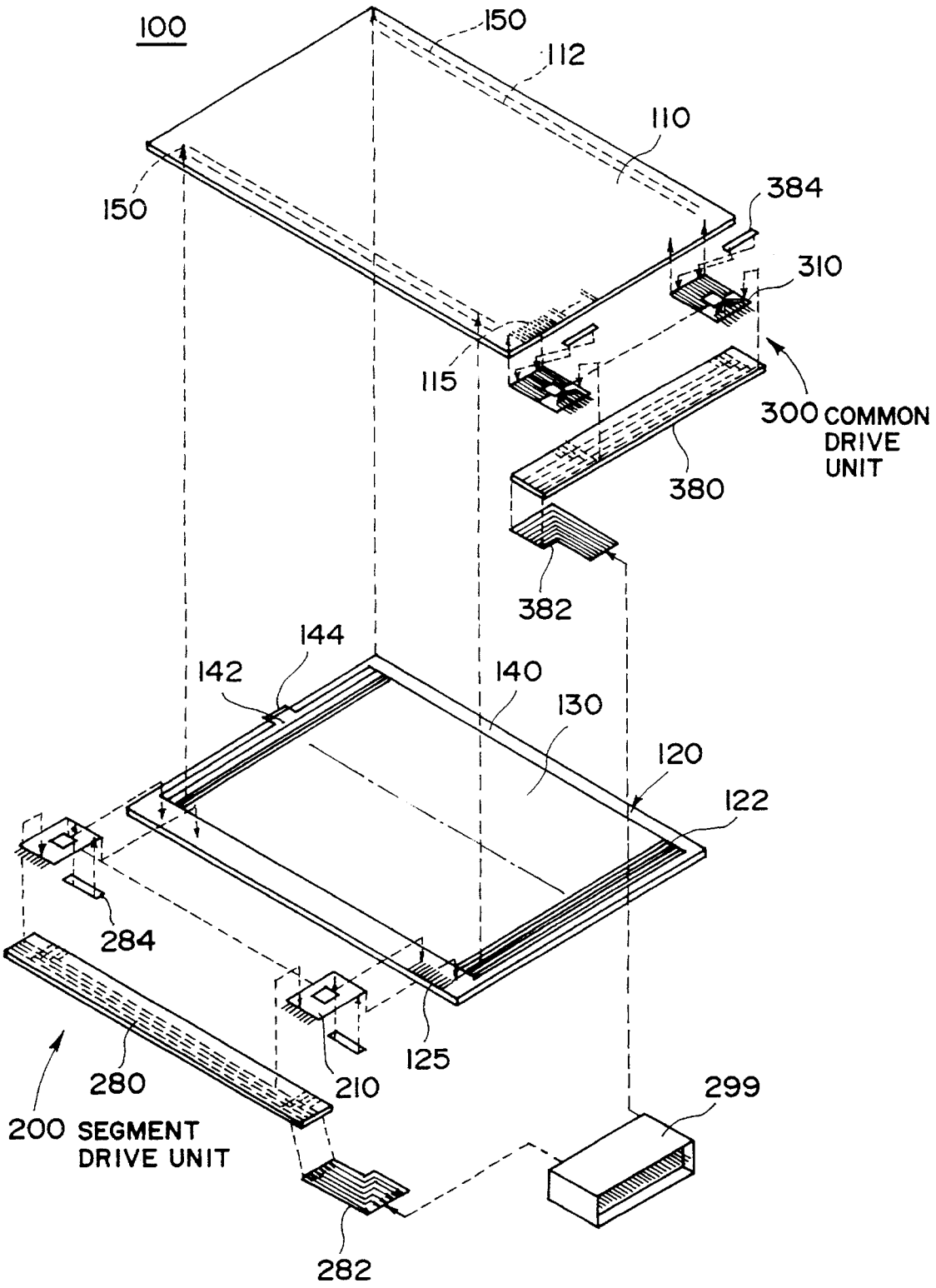
FIG. 8 is an exploded perspective view of a display panel used in the present invention.
Figure 9:
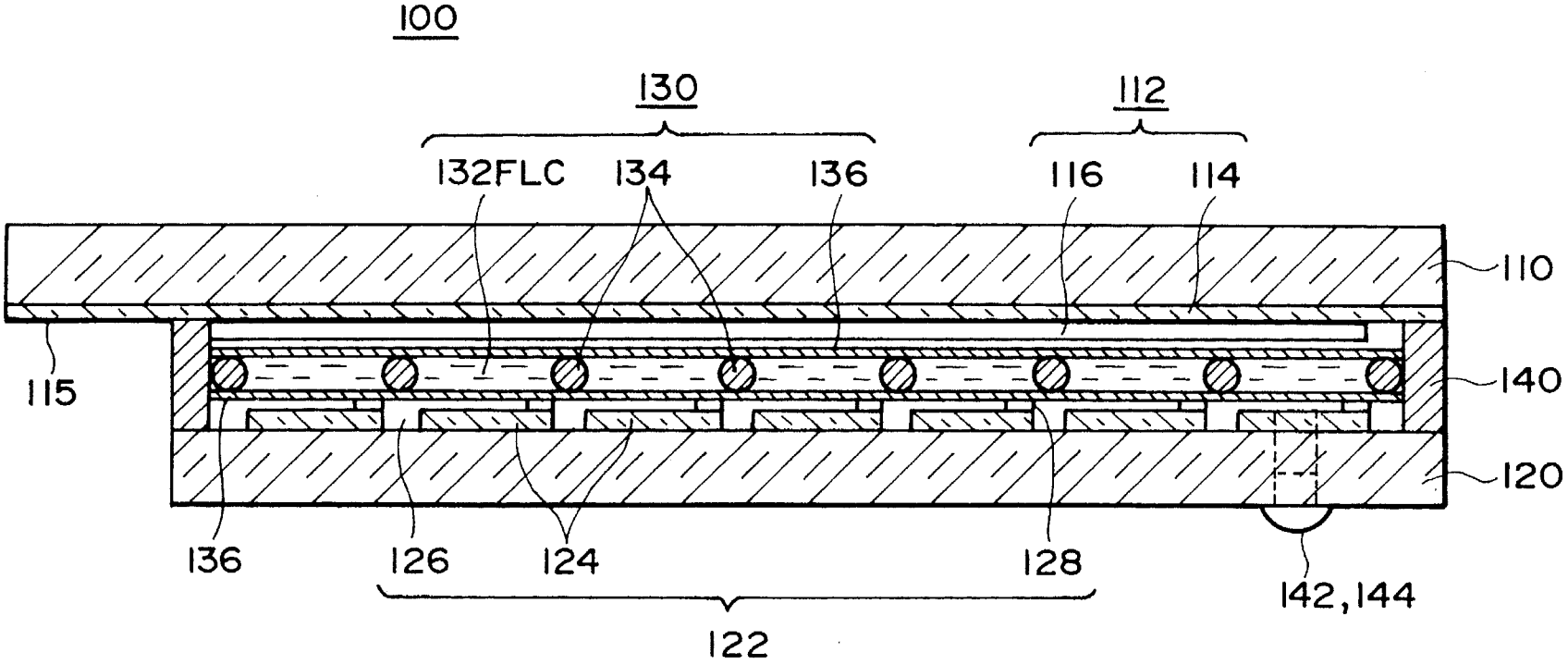
FIG. 9 is a schematic cross-sectional view of a display panel used in the invention.

FIGS. 8 and 9 are an exploded perspective view and a cross-sectional view, respectively, of an embodiment of a display panel 100 using an FLC. Referring to these figures, the display apparatus 100 comprises an upper glass substrate 110 and a lower glass substrate 120 provided with polarizers (not shown), respectively, forming a pair and arranged in cross nicols. The lower glass substrate 120 is provided with a wired or electrode region 122 comprising transparent electrodes 124 of, e.g., ITO, optionally accompanied with metal electrodes 128 for lowering the resistance formed on the transparent electrodes 124, and an insulating film 120. The metal electrodes 128 need not be added for a small display panel. The upper glass substrate 110 is provided with an electrode region 112 which comprises transparent electrodes 114 and an insulating film 116 similar to the members 124 and 126 of the electrode region 122 formed on the lower glass substrate 120.

The directions of electrode extension of the electrode regions 112 and 122 intersect each other at right angles. In order to provide an effective display region 104 of A5-size, for example, with its longer side disposed in the direction of horizontal scanning, and provide 400×800 pixels, each electrode region is provided with 400 or 800 transparent electrodes. In this embodiment, horizontal scanning electrodes (common electrodes) are formed by 400 transparent electrodes 114 disposed to constitute the upper electrode region 112, and data electrodes (segment electrodes) are formed by 800 transparent electrodes 124 to constitute the lower electrode region 122. Further, within the display area 102 and outside the effective display region 104, transparent electrodes 150 are disposed on the upper substrate 110 in the same or different shape compared with the transparent electrodes 114 for data display so as to intersect with extended parts of the transparent electrodes 124 to form a marginal non-display region.

An FLC-filling space 130 is formed between the substrates between the upper substrate 110 and lower substrate 120 and is defined by a pair of alignment films 136 for alignment films 136, spacers 134 for adjusting the gap between the alignment films 136 so as to satisfy a bistability condition and a sealing member 140 of, e.g., an epoxy resin, for sealing the FLC 132. An injection port 142 is formed in the sealing member 140 for injection of the FLC 132 into the filling space 130 and is sealed by a sealing member 144 for sealing the injection port 142 after the injection.

The data electrode drive circuit (segment drive unit) 200 comprises a segment drive element 210 and the scanning electrode drive circuit (common drive circuit) 300 comprises a common drive element 310. The segment drive element 210 and the common drive element 310 respectively comprise 10 and 5 integrated circuits each being used for driving 80 transparent electrodes. The segment and common drive elements 210 and 310 are disposed on substrates 280 and 380, respectively, and are connected through flexible cables 280 and 380, respectively and a connector 299 to the display control apparatus 50 (shown in FIG. 7).

Take-out electrodes 115 and 125 are continuously formed with the transparent electrodes 114 and 124, respectively, and are connected through film conductor members 384 and 284 to the drive elements 310 and 210, respectively.

In this embodiment, display is effected by driving the display panel 100 so as to drive the FLC at the respective pixels selectively to the first or second stable state while illuminating the display panel 100 by a light source FL disposed below the lower glass substrate 120.

The display panel 100 of this embodiment as shown in FIGS. 8 and 9 may be constituted and appropriately controlled for driving while noting the following factors relating to the characteristics of an FLC device.

In constituting a display panel 100 as shown in FIGS. 8 and 9, a region on a display area or surface 102 corresponding to a region where common-side transparent electrodes 114 and segment-side transparent electrodes 124 are disposed in a matrix is used as a region capable of actually displaying image data, i.e., an effective display region 104. In this instance, in order to make the effective display region 104 completely observable, it is desirable to constitute the display area 102 so as to include at least a part of a region which is outside the region of the common-side transparent electrodes (i.e., scanning electrodes) being disposed in a matrix and is inside the sealing member 140.

However, if only the segment-side transparent electrodes are extended to such a part, the FLC at the part cannot be supplied with an effective electric field for data display but only retains bistable states providing a mixture of transmissive portions (white) and non-transmissive portions (black), whereby not only the beauty of the display is impaired but also such a situation can occur that the definition of the effective display region 104 becomes difficult and an operator is under an optical illusion.

Accordingly, in this embodiment, marginal transparent electrodes 150 are disposed outside the effective display region 104 so as to intersect with the segment-side transparent electrodes 124 and are appropriately be driven to form a marginal region 106. More specifically, e.g., 16 electrodes 150 are disposed on the upper glass substrate 110 on both sides of the region where the common-side transparent electrodes 114 are disposed. In FIG. 8, one electrode 150 each is shown as a representative on both sides on the glass substrate 110. Alternatively, one broad marginal transparent electrode can be used instead.

Figure 10:
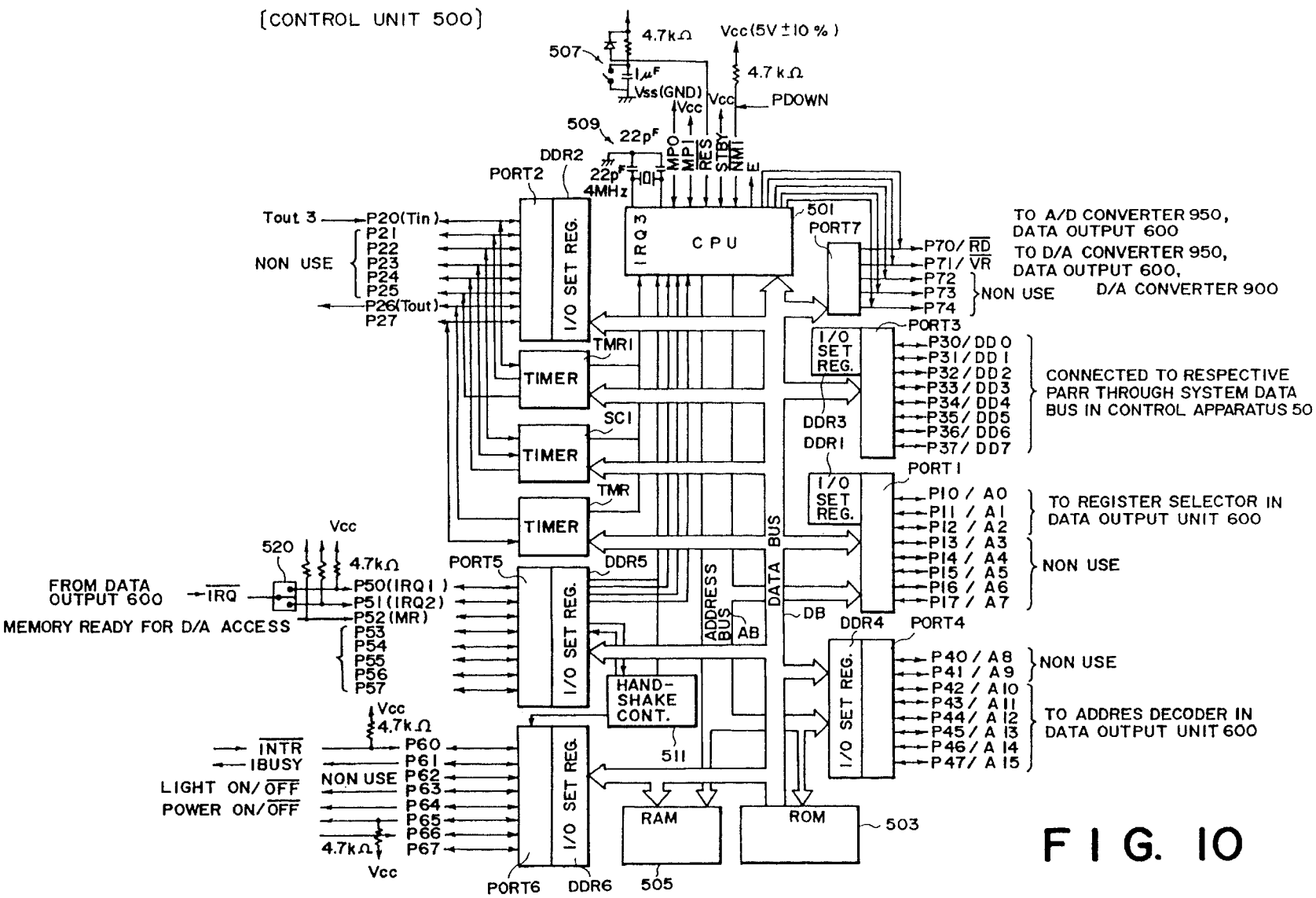
FIG. 10 is a block diagram of a control unit used in the invention.
Figure 12:
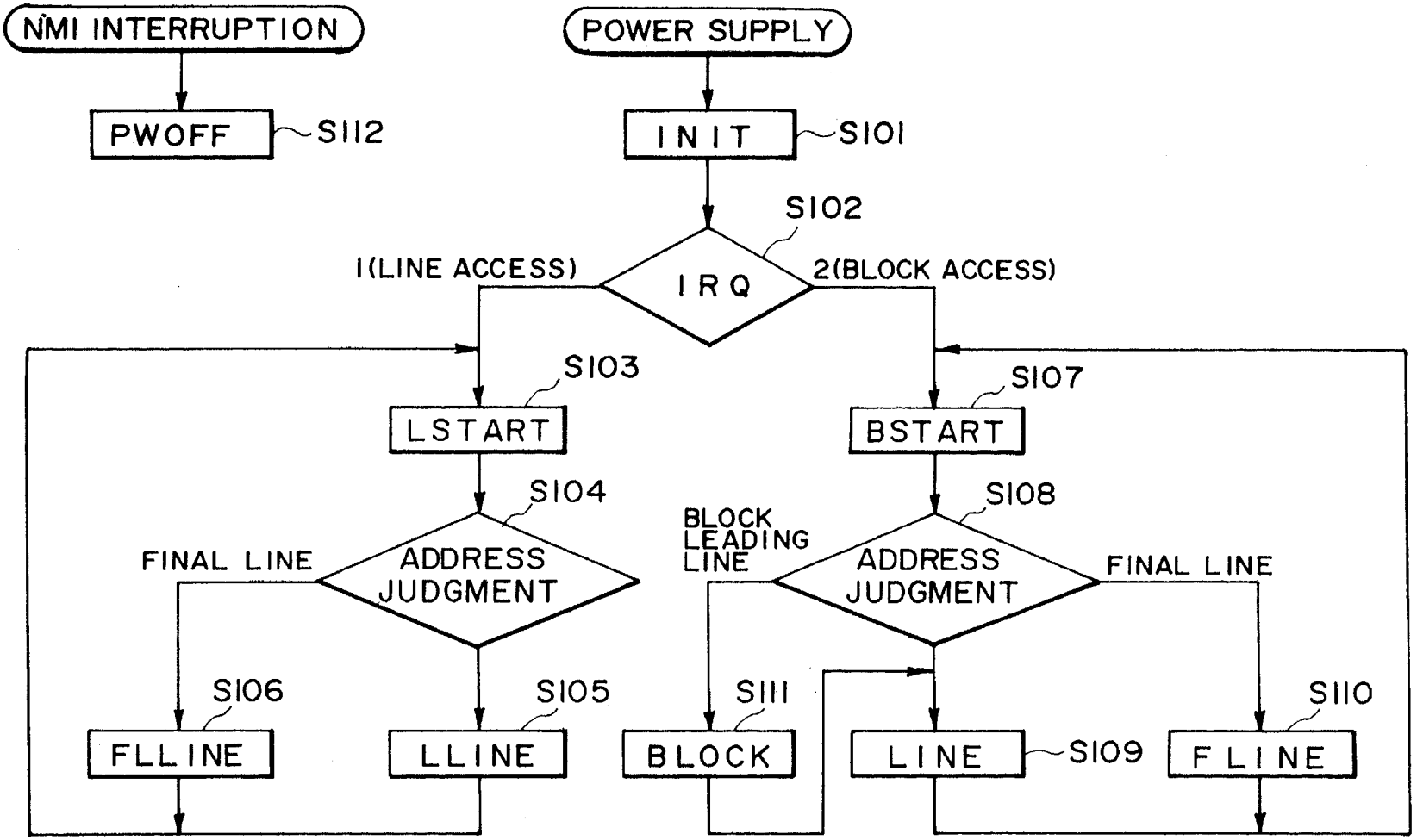
FIG. 12 is a flow chart showing a display control sequence used in the invention.

FIG. 10 shows an example of the control unit 500, which includes a CPU 501, e.g., in the form of a micro-processor for controlling the respective parts according to a control sequence shown in FIG. 12, a ROM 503 developing a program table corresponding to the control sequence shown in FIG. 12, and a RAM 505 used for operation during execution of the control sequence by the CPU 501.

PORT1–PORT6 are port units capable of setting input/output directions and comprise ports P10–P17, P20–P27, P30–P37, P40–P47, P50–P57 and P60–P67, respectively. PORT7 is an output port unit and comprising ports P70–P74. DDR1–DDR6 are input/output setting registers (data direction registers) for changing and setting the input/output directions of the ports PORT1–PORT6, respectively. In this embodiment, some members are not yet used, including: ports P13–P17 (corresponding to signals A3–A7) of the port unit PORT1; ports P21–P25 and P27 of the port unit PORT2; parts P40 and P41 (corresponding to signals A8 and A9, respectively) of the port unit PORT4; ports P53–P57 of the port unit PORT5; port P62 of the port unit PORT6, ports P72–P74 of the port unit PORT7; the terminals MP0, MP1 and STBY of the CPU 501.

A reset unit 507 is used to reset the CPU 501, and a clock pulse-generating unit 509 supplies basic clock pulses (4 MHz) for operation to the CPU 501.

TMR1, TMR2 and SCI are timers which are provided with a basic clock pulse generating source and a register, and are capable of frequency-demultiplying the basic clock pulses according to the setting of the register. The timer TMR2 demultiplies the basic clock pulses according to a register setting to provide a system clock signal Tout to the data output unit 600. The data output unit 600 generates a clock signal defining one horizontal scanning period (1H) of the display panel 100 based on the signal 100. The timer TMR1 is used for adjusting the operation periods on the program and the period 1H of the display panel 100 based on a set value for the register.

The timers TMR1 and TMR2 supply an internal interrupting signal IRQ3 to the CPU 501 at the times of completion of the set periods or start of a subsequent time counting following the completion, and the CPU accepts the signal according to necessity.

The timers SCI are not used in this embodiment.

Referring further to FIG. 10, AB and DB are an address bus and a data bus, respectively, internally connecting the CPU 501 and the respective parts, and 511 denotes a hand shake controller for the port units PORT 5 and PORT 6 with the CPU 501.

Figure 11:
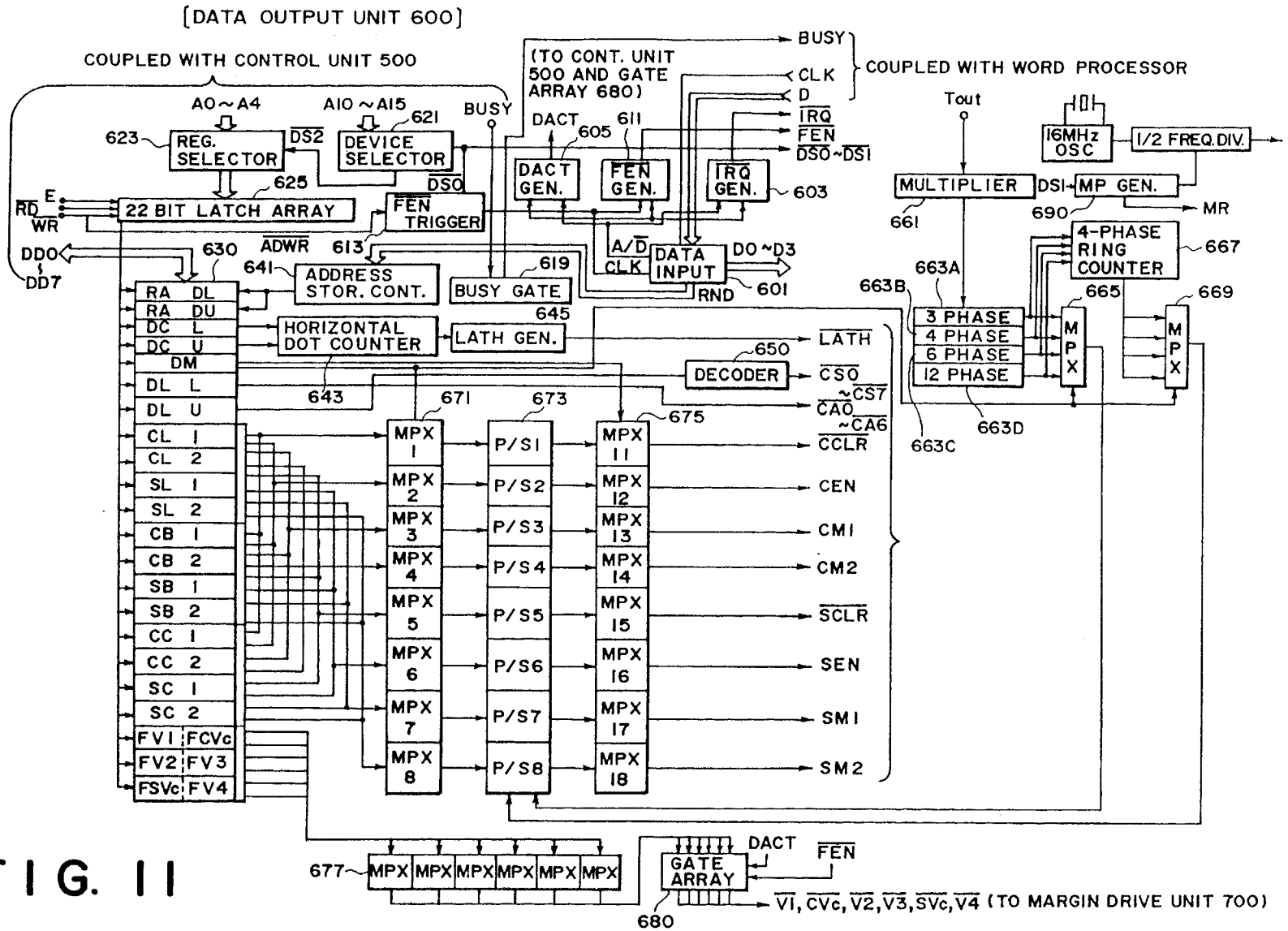
FIG. 11 is a block diagram of a data output unit used in the invention.

FIG. 11 shows an example of the data output unit 600, which includes a data input unit 601 which is coupled with the word processor main fame 71 and receives and supplies a signal D and a transfer clock signal CLK. The signal D is supplied from the word processor main frame 71 on receiving image signals and a horizontal synchronizing signal. In this embodiment, the horizontal scanning signal or horizontal flyback erasure period is supplied in superposition with actual address data. The data input unit 601 charges over data output process depending on detection or non-detection of the horizontal synchronizing signal or horizontal flyback erasure period. More specifically, at the time of detection, the data input unit 601 recognizes the signal component superposed at that time as real or actual address data and outputs the signal as address data RA/D. At the time of non-detection, the signal component is recognized as image data and is outputted as four bits parallel image data D0–D3.

Further, the data input unit 601 outputs an address/data recognition signal A/$\overline{D}$, and the signal A/$\overline{D}$ is guided to an $\overline{IRQ}$ generating unit 603 and a DACT generating unit 605. On receiving the signal A/$\overline{D}$, the $\overline{IRQ}$ generating unit outputs an interrupting signal $\overline{IRQ}$, which is supplied as an interrupting command $\overline{IRQ1}$ or $\overline{IRQ2}$ to the control unit 500 depending on the setting of a switch 520 (FIG. 5), to effect an operation according to a line-access mode or a block-access mode. On the other hand, a DACT generating unit 605 outputs a DACT signal for detecting the access or non-access of the display panel 100 depending on the input of the signal A/$\overline{D}$, and the DACT signal is supplied to the control unit 500, an $\overline{FEN}$ generating unit 611 and a gate array 600.

At the time of energization with the DACT signal, the $\overline{FEN}$ generating unit 611 generates a signal $\overline{FEN}$ for starting the gate array depending on a trigger signal from the $\overline{FEN}$ trigger signal generating unit 613. The $\overline{FEN}$ trigger signal generating unit 613 generates the trigger signal based on a writing signal $\overline{ADWR}$ which is a signal issued by the control unit 500 to command the A/D converter 950 to take in temperature data from the temperature sensor 400. Further, the $\overline{FEN}$ trigger signal generating unit 613 is selected based on a chip selecting signal $\overline{DSO}$ issued by a device selector 621. More specifically, when the control unit 500 selects the A/D converter 950 so as to read the temperature data, the $\overline{FEN}$ trigger signal generating unit 613 is also selected and the margin drive is also started.

A busy gate 619 is also included so as to supply to the word processor main frame 71 a signal BUSY for notifying the busy state of the display control apparatus depending on a busy signal IBUSY from the control unit 500.

The device selector 621 receives signals A10–A15 from the control unit 500 and, depending on the values thereof, outputs signals $\overline{DS0}$–$\overline{DS2}$ for selecting the A/D converter 950, D/A converter 900 and data output unit 600. A register selector 623 is started by the signal $\overline{DS2}$ to set a latch pulse gate array 625 based on signals A0–A4 from the control unit 500. The latch pulse gate array 625 selects the respective registers in a register unit 630 and comprises a number of bits corresponding to the number of registers in the register unit 630. In this embodiment, the register unit 630 comprises 22 register (registers) each of 1 byte (8 bits), and the latch pulse gate array 625 is composed of 22 bits each corresponding to one of the regions. More specifically, when the register selector 623 sets a bit in the latch pulse gate array 625, a register corresponding to the bit is selected and the selected register is subjected to reading or writing of data through a system data bus corresponding to a read signal $\overline{RD}$ or write signal $\overline{WR}$ supplied to the latch pulse gate array 625 from the control unit 500.

In the register unit 630, RA/DL and RA/DU are real address data registers for storing a lower 1 byte and an upper 1 byte of real address data RA/D under the control by a real address storage control unit 641.

DCL and DCU are horizontal dot count data registers for storing a lower 1 byte and an upper 1 byte of data corresponding to a number of dots (800 dots in this embodiment) ill the horizontal scanning electrode direction in a display. A horizontal dot number counter 643 is started by the commencement of transfer of image data D0–D3 to count an appropriate number of clock pulses and lets a latch signal $\overline{LATH}$ generating unit 645 generate a latch signal when it completes counting numbers equal to those stored in the registers DCL and DCU.

DM is a drive mode register and mode data corresponding to line-access or block access are written therein.

DLL and DLU are registers for common line selection address data and store a lower 1 byte and a higher 1 byte with respect to 16 bit data. Data stored in the register DLL are outputted as address data CA6 and CA5 for designating a block and address data CA4–CA0 for designating a line. Further, data stored in the register DLU are supplied to a decoder unit 650 and outputted therefrom as chip selection signals $\overline{CS0}$–$\overline{CS7}$ for selection in the common drive unit 310.

CL1 and CL2 are respectively a region of 1 byte for storing drive data supplied to the common-side drive unit 300 in common-side line drive (line-writing) according to the block access mode. SL1 and SL2 are respectively a region of 1 byte for storing drive data supplied to the segment-side drive unit 200 in segment-side line drive according to the same mode.

CB1 and CB2 are respectively a region of 1 byte for storing drive data supplied to the common-side drive unit 300 in common-side line drive at the time of block erasure according to the block access mode. SB1 and SB2 are respectively a region of 1 byte for storing drive data supplied to the segment-side drive unit 200 correspondingly.

CC1 and CC2 are respectively a region of 1 byte for storing drive data supplied to common-side drive unit 300 in common-side line drive at the time of line writing according to the line access mode, and SC1 and SC2 are respectively a region of 1 byte for storing drive data supplied to the segment-side drive unit 200 correspondingly.

Subsequent three regions each of 1 byte are regions for storing data for switching by the margin drive unit and they are divided into sub-regions each of 4 bits to provide registers $FV_1$, $FCV_C$, FV2, FV3, $FSV_C$ and FV4.

A successive multiplier 661 is used to successively multiply a pulse signal Tout from the control unit 500, e.g., into two times. Ring counters of 3 phases (663A), 4 phases (663B), 6 phases (663C) and 12 phases (663D) are used to count the outputs from the successive multiplier 661 so as to effect division into ¼, ⅓, ½ and 1/1 of one horizontal scanning period (1H). Each of the resultant divided periods is denoted by ΔT hereinafter. In case of the three division (division into ⅓), 1H is constituted by 3ΔT.

A multiplexer 665 is used to select any of the outputs from the ring counters 663A–663D and is actuated depending on the data in the drive mode register DM, i.e., data indicating how many divisions the period 1H is divided into. In case of three divisions for example, the output from the four-phase ring counter 663B is selected.

A 4-phase ring counter 667 is used for the respective outputs from the ring counters 663A–663D together with a multiplexer 669 which is actuated similarly as the multiplexer 665.

FIG. 12 is a flow chart illustrating the outline of display control used in the present invention.

First of all, when the power is turned on to the word processor main frame 71, an INIT routine is automatically started (S101), wherein the "Busy" signal is turned on, the margin display region 106 is driven, the effective display region is erased and the temperature compensation therefor is performed, respectively, at the time of power on, and finely the "Busy" signal is turned off to wait until an interruption request $\overline{IRQ1}$ or $\overline{IRQ2}$ comes. The interruption request $\overline{IRQ1}$ or $\overline{IRQ2}$ is generated by transfer of address data from the main frame 71, and unless the address data come, the display picture 102 remains still.

Then, when the address data are transferred to issue an interruption request, a subsequent step S102 is started. Thus, if the interruption request is $\overline{IRQ1}$, an LSTART routine is started, and if the interruption request is $\overline{IRQ2}$, a BSTART routine is started. According to this branching, it is determined whether the above-mentioned block access or line access is performed. More specifically, the line access is performed if the LSTART routine is started and the block access is started if the BSTART routine is started.

In this embodiment, the setting of $\overline{IRQ1}$ or $\overline{IRQ2}$ is manually performed in advance by a switching means 520 disposed at an appropriate part in the display control apparatus 50.

When the line access mode is set by the switching means and $\overline{IRQ1}$ is generated, the LSTART routine is started and executed, wherein address data transferred from the data output unit are read and judged as to whether the data are for the final line in the effective display region 104 (steps 103 and 104). If the data are not for the final line, the program is branched to start an LLINE routine, wherein the "Busy" signal is turned ON, writing of one scanning line is effected based on image data transferred subsequent to the address data and then the "Busy" signal is turned OFF to wait for an interruption request $\overline{IRQ1}$ (step S105). When $\overline{IRQ1}$ is supplied, the LSTART routine is started again.

In the step S104, if the address data are for the final line, the program is branched to start an FLLINE routine, wherein the writing on the final line is performed based on the transferred image data. Then, the margin display is performed, the temperature compensation data are renewed and the "Busy" signal is turned OFF to wait for an interruption request $\overline{IRQ1}$ (step S106). Then, if the interruption request $\overline{IRQ1}$ is supplied, the LSTART routine is re-started. According to the above-described procedure, the display control according to the line access mode is performed.

On the other hand, if the block access mode is set by the above-mentioned switching means 520, a BSTART routine is started when an interruption request $\overline{IRQ2}$ is generated by transfer of address data. In the routine, "Busy" signal is turned ON, the transferred address data are read to judge whether the data are for the leading line in a block, for the final line in the effective driving region 104 or for other lines (steps S107 and S108).

If the address data do not indicate the leading line or the final line, the program is branched to a LINE routine, wherein writing of one line is performed based on transferred image data and then "Busy" signal is turned OFF to wait for an interruption request (step S109). If an internal interrupting request $\overline{IRQ2}$ is supplied, the BSTART routine is re-started.

In step S108, if the address data indicates the final line in the effective display region 104, an FLINE routine is started. In the routine, writing of one line is performed, the marginal drive is performed, the temperature compensation data are renewed, and "Busy" signal is turned OFF to wait for an interruption request (step S110). If an interruption request $\overline{IRQ2}$ is supplied, the $\overline{BSTART}$ routine is re-started.

In the step S108, if the address data indicate the leading line of a block, the execution is branched to a BLOCK routine, wherein a block including the lines indicated by the address data is entirely erased into "white" (step S111) and then the LINE routine (step S109) is started to perform similar actions as described above. In the above-described sequence, the display control according to the block access mode is performed to effect data writing.

Further, when the word processor 71 supplies a power down signal PDOWN to the control unit 500, a non-maskable interruption request NM1 is generated by the signal to start a PWOFF routine, wherein "Busy" signal is turned ON, the effective display region 104 is entirely erased into "white". Then, a power status signal and "Busy" signal are turned OFF to shut off the power to the word processor main frame 71.

As is apparent from the above description, even if either of the two modes of display control, i.e., the block access mode and line access mode, is performed, a refresh drive is effected if address data are sequentially transferred cyclically and continuously over the entire effective display region, and a partial rewriting drive is effected if address data for a certain part are transferred intermittently.

In the detailed explanation of control sequence hereinbelow, it is assumed that address data and image data are transferred from the main frame 71 according to the refresh drive mode.

The signals and data transferred between the respective parts used in the above embodiment are summarized as follows:

| Signal | Signal name | Supplier | Receiver |
|---|---|---|---|
| Tout | System clock pulse | Control unit 500 (PORT2) | Data output unit 600 |

(Brief description) Basic clock pulses for operation of the data output unit. Also supplied to the control unit 500 so as to synchronize the time on the control program and the time on the display and always ensure a stable one horizontal scanning period.

| | | | |
|---|---|---|---|
| $\overline{IRQ1}$ | Line-access interruption | Data output unit 600 | Control unit 500 (PORT5) |
| $\overline{IRQ2}$ | Block-access interruption | Data output unit 600 | Control unit 500 (PORT5) |

Either one is supplied to the data control unit 500 depending on an interruption signal IRQ generated by the data output unit 600 based on real address data supplied from the word processor main frame 71.

| | | | |
|---|---|---|---|
| MR | Memory ready unit | MR generating 500 (PORT5) | Control unit |

Signal for timing the access to the D/A controller 900.

| | | | |
|---|---|---|---|
| $\overline{INTR}$ | A/D conversion completion notification | A/D converter 950 | Control unit (PORT6) |

Signal for notifying that the A/D conversion of detected temperature data has been completed.

| | | | |
|---|---|---|---|
| IBUSY | Busy | Control unit 500 (PORT6) | Data output unit 600 |

Supplied to the data output unit 600 so as to notify the word processor main frame 71.

| | | | |
|---|---|---|---|
| Light | Light source control | Control unit 500 (PORT6) | Main frame 71 |

Requiring the turning ON/OFF of the light source FL.

| | | | |
|---|---|---|---|
| P ON/OFF | Power status | Control unit 500 (PORT6) | Main frame 71 |

Requiring the turning ON/OFF of the power supply.

| | | | |
|---|---|---|---|
| DACT | Panel access discrimination | Data output unit 600 (DACT generating unit) | Control unit 500 (PORT500) Data output unit 600 (Gate array 680) |

Signal for discriminating the access/non-access to the effective display region 104.

| | | | |
|---|---|---|---|
| $\overline{RD}$ | Read signal | Control unit 500 (PORT7) | A/D converter 950 Data output unit 600 |

Control signal for reading data from the respective input units.

| | | | |
|---|---|---|---|
| $\overline{WR}$ | Write signal | Control unit 500 (PORT7) | A/D converter 950 D/A converter 900 Data output unit 600 |

Control signal for reading data by the respective units.

| | | | |
|---|---|---|---|
| DD0–DD7 | Data on system data bus | Respective units | Respective units |
| A0–A15 | Address signal | Control unit 500 (PORT1, PORT4) | Data output unit 600 |

Used for having the data output unit 600 select the respective units.

| | | | |
|---|---|---|---|
| $\overline{RES}$ | Reset signal | Control unit 500 (Reset unit 507) | Control unit 500 (CPU 501) |

Resetting the CPU 501 in the control unit 500.

| | | | |
|---|---|---|---|
| $\overline{NMI}$ (PDOWN) | Non-maskable interruption (Power-off interruption) | Main frame 71 | Control unit 500 (CPU) |

Supplied to the control unit 500 for appropriate actions based on the signal PDOWN from the main frame 71 for notifying power-off.

| | | | |
|---|---|---|---|
| E | Clock pulses | Control unit 500 (CPU) | D/A converter 900 Data output unit 600 |

Clock pulses outputted with durations approximately modified depending on the signal for appropriately accessing the D/A converter 900 or data output unit 600.

| | | | |
|---|---|---|---|
| D0–D3 | Image data | Data output unit 600 | Segment-side drive unit 200 |

Produced from image data as a signal D supplied from the main frame 71.

| | | | |
|---|---|---|---|
| D | — | Main frame 71 | Data output unit 600 |

Signal including data to be displayed, actual address data and a horizontal synchronizing signal.

| | | | |
|---|---|---|---|
| CLK | Transfer clock pulses | Main frame 71 | Data output unit 600 |

Transfer clock pulses for the signal D.

| | | | |
|---|---|---|---|
| $A/\bar{D}$ | Address/data discrimination | Data output unit 600 | Data output unit 600 |

Signal for identifying data supplied as the signal whether they are image data or actual address data.

| | | | |
|---|---|---|---|
| RA/D | Real address data | Data output unit 600 (Data input unit 601) | Data output unit 600 (Register 630) |

Applied to data for specifying the display position. Corresponding to one line and produced from data supplied as the signal D from the main frame 71 in superposition with a horizontal synchronizing signal.

| | | | |
|---|---|---|---|
| IRQ | Interruption | Data output unit 600 | Control unit 500 |

Supplied to the control unit 500 depending on the signal A/$\overline{D}$ and supplied to the control unit 500 as $\overline{IRQ1}$ or $\overline{IRQ2}$ depending on the setting.

| | | | |
|---|---|---|---|
| IRQ3 | Internal interruption | Control unit 500 (Timer) | Control unit 500 (CPU) |

Internal interruption signal for canceling a non-operative state (sleep state).

| | | | |
|---|---|---|---|
| $\overline{FEN}$ | Frame end | Data output unit 600 ($\overline{FEN}$ generating unit) | Data output unit 600 (Gate array 680) |

Used for forming a lateral margin.

| | | | |
|---|---|---|---|
| $\overline{DS0}$ | Chip select | Date output unit 600 (Device selector 621) | A/D converter 950 |
| $\overline{DS1}$ | | | D/A converter 900 |
| $\overline{DS2}$ | | | Data output unit 600 (Register selector 623) |
| $\overline{DS3}$ | | | Non-use |

Generated depending on the signals A10–A15 from the control unit 500 and used as chip selection signals for the control unit 500.

| | | | |
|---|---|---|---|
| $\overline{LATH}$ | Latch | Data output unit 600 | Segment drive unit 200 (Drive element 210) |

Signal for latching data (image data) in a shift register in the element 210 into a line memory.

| | | | |
|---|---|---|---|
| CA0–CA6 | Line selection | Data output unit 600 | Common drive unit 300 (Drive element 310) |

Signals supplied to the element 310 for selecting horizontal scanning output lines CA5 and CA6 are used for block selection, and CA0–CA4 are used for selection of lines in a block.

| | | | |
|---|---|---|---|
| $\overline{CCLR}$ | Clearing | Data output unit 600 | Common drive unit 300 |
| CEN | Enabling | Data output unit 300 | Common drive unit 300 |
| CM1, CM2 | Waveform defining | Data output unit 600 | Common drive unit 300 |

Used for defining output waveforms from the common drive element 310.

| | | | |
|---|---|---|---|
| $\overline{SCLR}$ | Clearing | Data output unit 600 | Segment drive unit 200 |
| SEN | Enabling | Data output unit 600 | Segment drive unit 200 |
| SM1, SM2 | Waveform defining | Data output unit 600 | Segment drive unit 200 |

Used for defining output waveforms from the segment drive element 210.

| | | | |
|---|---|---|---|
| $\overline{V1}$–$\overline{V4}$ $\overline{CV_C}$–$\overline{SV_C}$ | Margin drive switching | Data output unit 600 | Margin drive unit 700 |

Used for defining outputs from the margin drive unit 700.

| | | | |
|---|---|---|---|
| V1, V2 | Voltage | Power controller 800 | Common drive 300 |

Defining output voltage (two valve of opposite polarities) from the element 310.

| | | | |
|---|---|---|---|
| V3, V4 | Voltage | Power controller 800 | Segment drive unit 200 |

Defining output voltages (two values of opposite polarities) from the element 210.

| | | | |
|---|---|---|---|
| $V_C$ | Voltage | Power controller 800 | Drive units 200, 300 |

Defining the reference level ("0") of the output voltages.

Figure 13:
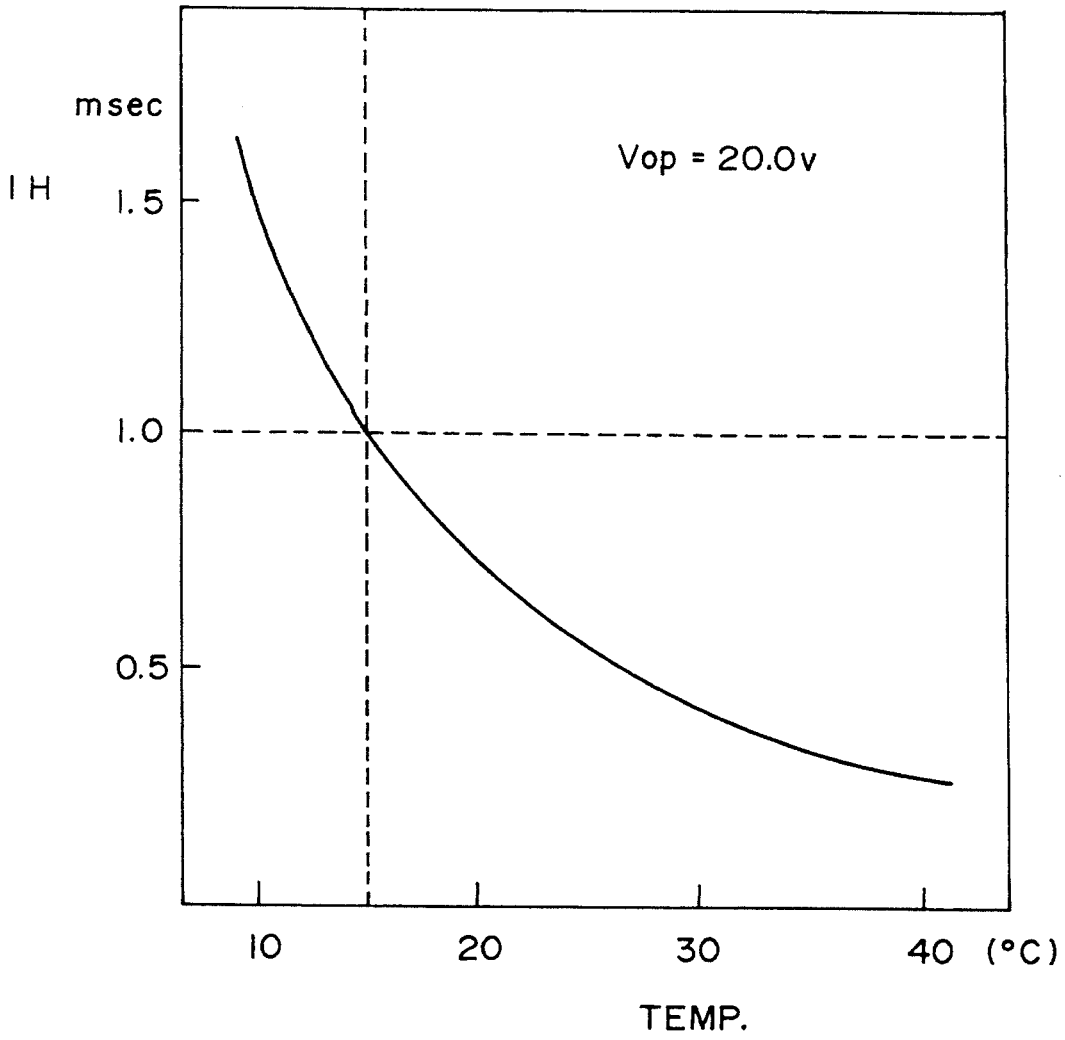
FIG. 13 is an explanatory diagram for illustrating an optimum drive characteristic.

FIG. 13 is a diagram for illustrating optimum drive conditions for an FLC at prescribed temperatures. An optimum drive voltage and one horizontal scanning period are controlled by the control unit 500 depending on the temperature data detected by the temperature sensor 400.

In the present invention, the occurrence of flickering in the marginal display region 106 may be suppressed by driving the marginal display region 106 at a frequency of 20 Hz or higher. In this instance, if the environmental temperature varies, the optimum condition for one horizontal scanning period (1H) is changed so that a lower environmental temperature provides a longer 1H period. Accordingly, in the present invention, in order to maintain the driving frequency for the marginal non-display region 106 at 20 Hz or higher, the marginal region is caused to be driven after driving of a prescribed number of scanning electrodes in the display region 104, and the prescribed number is increased at a higher temperature. The counting of the prescribed number of the scanning electrodes is performed in the control unit 500.

Figure 14B:
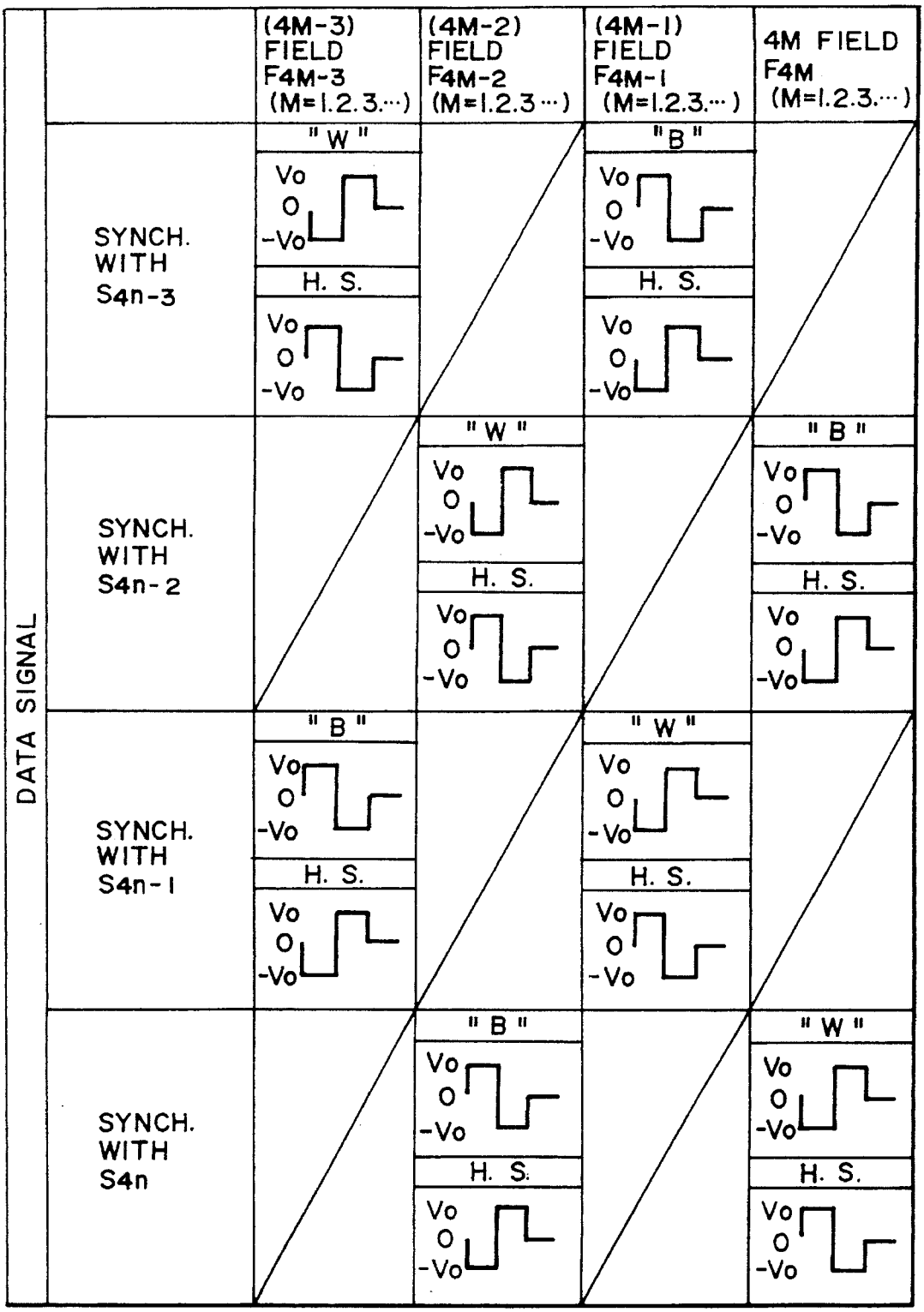

FIGS. 14A and 14B show a set of driving waveforms used in a multi-interlaced drive system (selection with skipping of two or mores scanning electrodes) adopted in the present invention.

More specifically, FIG. 14A shows a scanning selection signal $S_{4n-3}$ (n=1, 2, 3, . . . ) applied to a (4n–3)th scanning electrode, a scanning selection signal $S_{4n-2}$ applied to a (4n–2)th scanning electrode, a scanning selection signal S4n–1 applied to a (4n–1)th scanning electrode and a scanning selection signal applied to a 4n-th scanning electrode which are respectively applied in a (4M–3)th field $F_4M-3$, a (4M–2)th field $F_{4M-2}$, a (4M–1)th field $F_{4M-1}$ and a 4Mth field $F_{4M}$ (M=1, 2, 3 . . . ). Herein, one field means one vertical scanning operation or period). According to FIG. 14A, the scanning selection signal $S_{4n-3}$ has voltage polarities (with respect to the voltage level of a scanning non-selection signal) which are opposite to each other in the corresponding phases of the (4M–3)th field $F_{4M-3}$ and (4M–1)th field $F_{4M-1}$, while the scanning selection signal $S_{4n-3}$ is so composed as to effect no scanning i.e. so as to be a scanning non-selection signal, in the (4M–2)th field $F_{4M-2}$ or 4Mth field $F_{4M}$. The scanning selection signal $S_{4n-1}$ is similar, but the scanning selection signal $S_{4n-3}$ and $S_{4n-1}$ applied in one field period have different voltage waveforms and have mutually opposite voltage polarities in the corresponding phases.

Similarly, the scanning selection signal $S_{4n-2}$ has voltage polarities (with respect to the voltage level of the scanning non-selection signal) which are mutually opposite in the corresponding phases of the (4M–2)th field $F_{4M-2}$ and 4Mth field $F_{4M}$ and effects no scan in the (4M–3)th field $F_{4M}$_3 or (4M–1)th field $F_{4M-1}$. The scanning selection signal $S_{4n}$ is similar, but the scanning selection signals $S_{4n-2}$ and $S_{4n}$ applied in one field period have different voltage waveforms and have mutually opposite voltage polarities in the corresponding phases.

Further, in the driving waveform embodiment shown in FIGS. 14A and 14B, a third phase is disposed for providing a pause to the whole picture (e.g., by applying a voltage of 0 simultaneously to all the pixels constituting the picture), and for this purpose, the scanning selection signals are set to have a voltage of zero (the same voltage level as the scanning non-selection signal).

Referring to FIG. 14B, data signals applied to data electrodes in the (4M–3)th field $F_{4M-3}$ comprise a white signal (one for providing a voltage 3 $V_0$ exceeding a threshold voltage of the FLC at the second phase in combination with the scanning selection signal $S_{4n-3}$ to form a white pixel) and a hold signal (one for applying to a pixel a voltage $\pm V_0$ below the threshold voltage of the FLC in combination with the scanning selection signal $S_{4n-3}$) which are selectively applied in synchronism with the scanning selection signal $S_{4n-3}$; and a black signal (for providing a voltage $-3V_0$ exceeding a threshold voltage of the FLC at the second phase in combination with the scanning selection signal $S_{4n-1}$ to form a black pixel) and a hold signal (for applying to a pixel a voltage $\pm V_0$ below the threshold voltage of the ferroelectric liquid crystal in combination with the scanning selection signal $S_{4n-1}$) which are selectively applied in synchronism with the scanning selection signal $S_{4n-1}$. On the contrary, the (4n–2)th scanning electrode and (4n)th scanning electrode are supplied with a scanning non-selection signal, so that the pixels on these scanning electrodes are supplied with the data signals as they are.

In the (4M–2)th field $F_{4M-2}$ subsequent to the writing in the above-mentioned (4M–3)th field $F_{4M-3}$, data signals applied to the data electrodes comprise the above-mentioned white signal and hold signal which are selectively applied in synchronism with the scanning selection signal $S_{4n-2}$; and the above-mentioned black signal and hold signal which are selectively applied in synchronism with the scanning selection signal $S_{4n}$. On the other hand, the (4n–3)th and (4n–1)th scanning electrodes are supplied with a scanning non-selection signal so that the data signals are applied as they are to the pixels on these scanning electrodes.

In the (4M–1)th field $F_{4M-1}$ subsequent to the writing in the above-mentioned (4M–2)th field $F_{4M-2}$, data signals applied to the data electrodes comprise the above-mentioned black signal and hold signal which are selectively applied in synchronism with the scanning selection signal $S_{4n-3}$; and the above-mentioned white signal and hold signal which are selectively applied in synchronism with the scanning selection signal $S_{4n-1}$. On the other hand, the (4n–2)th and (4n)th scanning electrodes are supplied with a scanning non-selection signal so that the data signals are applied as they are to the pixels on these scanning electrodes.

In the 4Mth field $F_{4M}$ subsequent to the writing in the above-mentioned (4M–1)th field $F_{4M-1}$, data signals applied to the data electrodes comprise the above-mentioned black signal and hold signal which are selectively applied in synchronism with the scanning selection signal $S_{4n-2}$; and the above-mentioned white signal and hold signal which are selectively applied in synchronism with the scanning selection signal $S_{4n}$. On the other hand, the (4n–3)th and (4n–1)th scanning electrodes are supplied with a scanning non-selection signal so that the data signals are applied as they are to the pixels on these scanning electrodes.

Figure 15A:
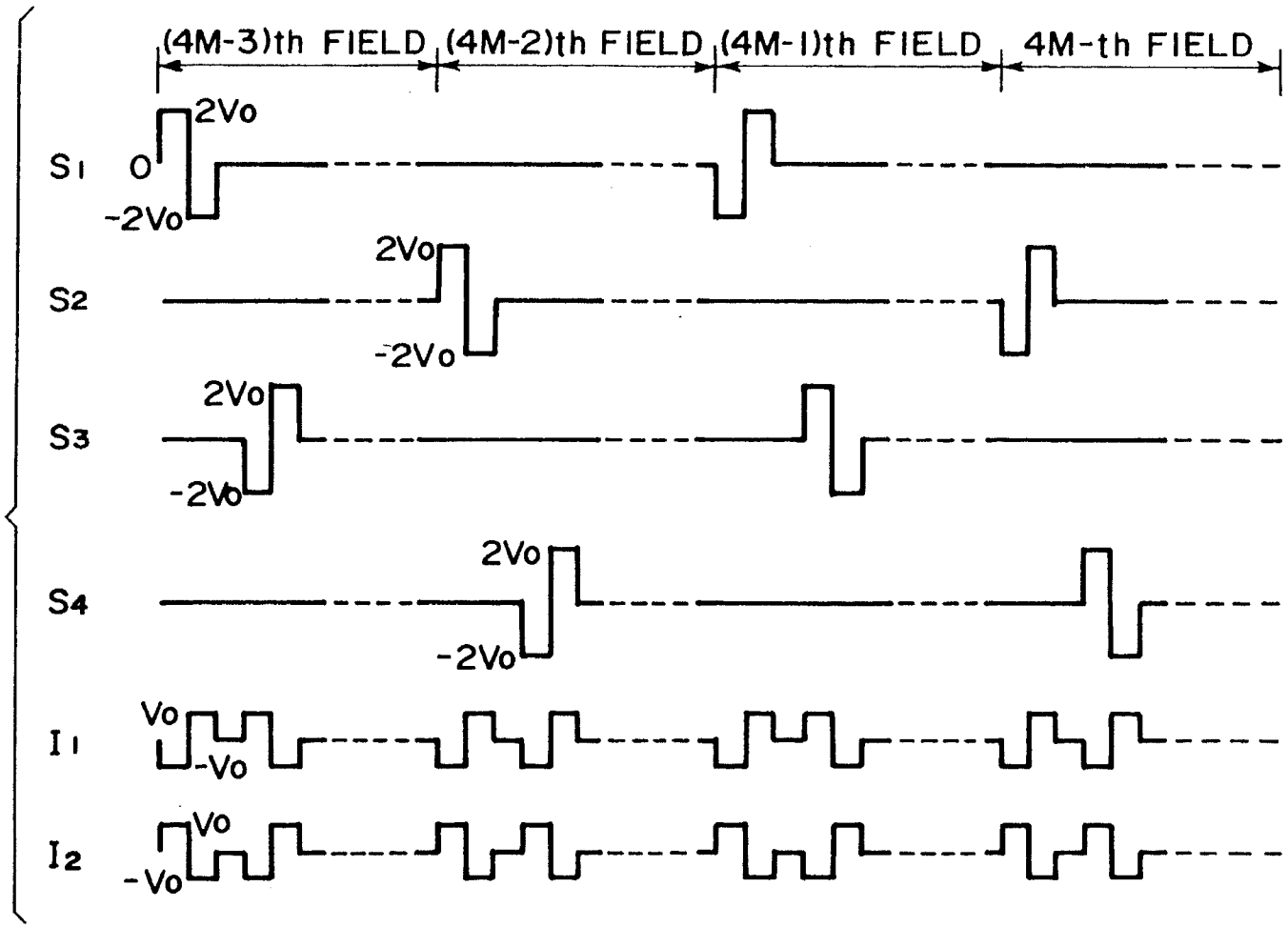
Figure 15B:
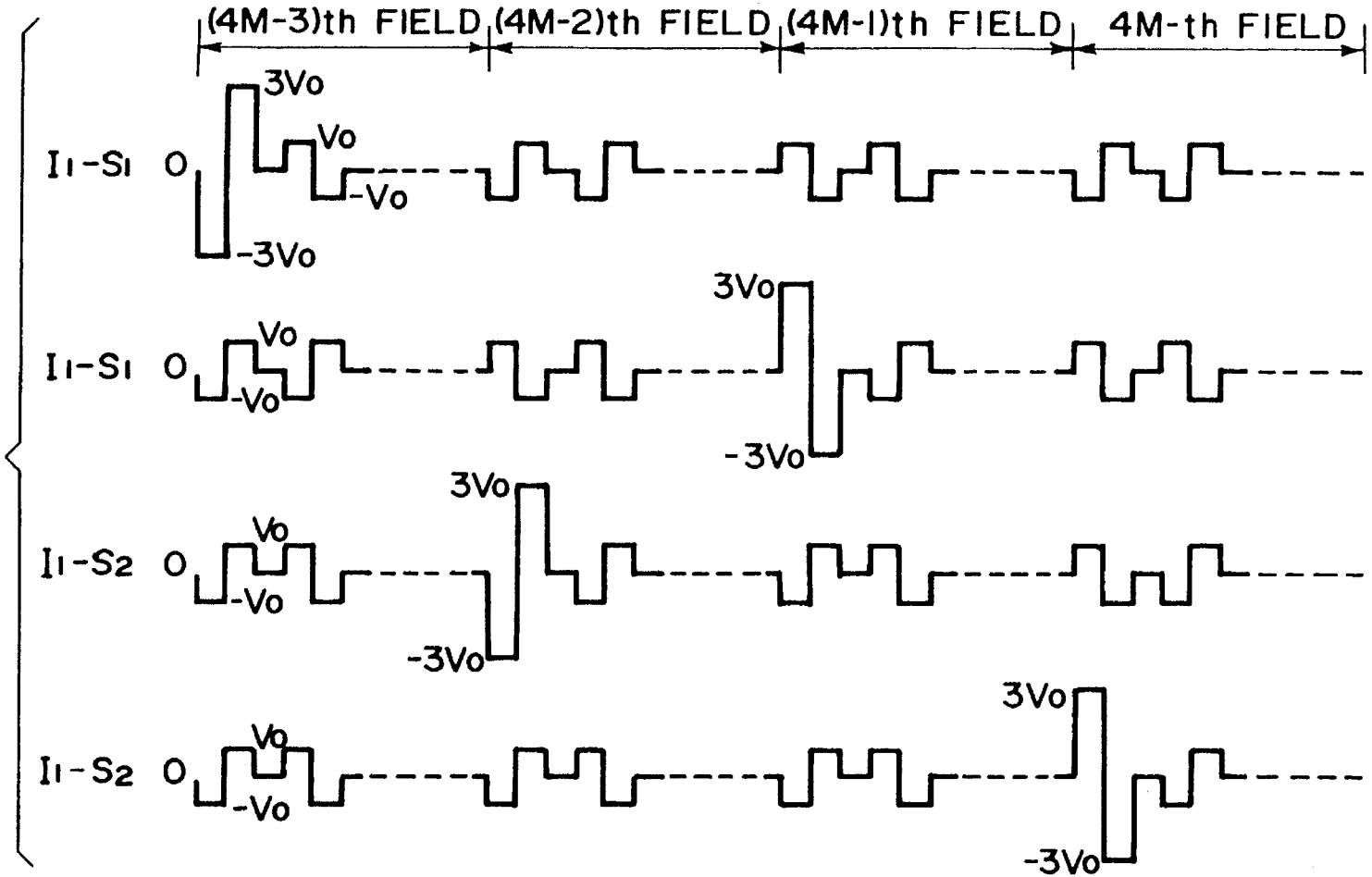
Figure 15C:
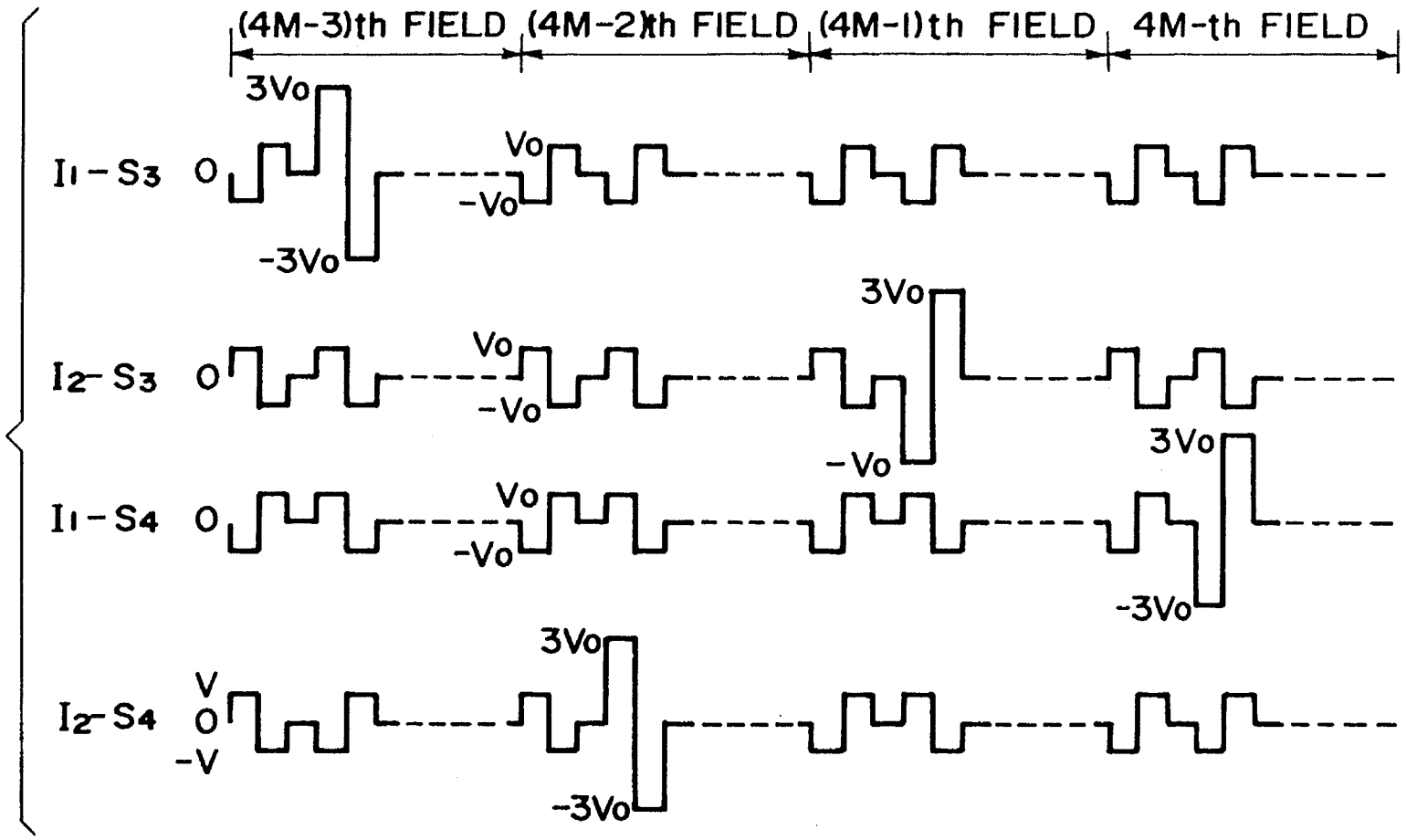
Figure 15D:
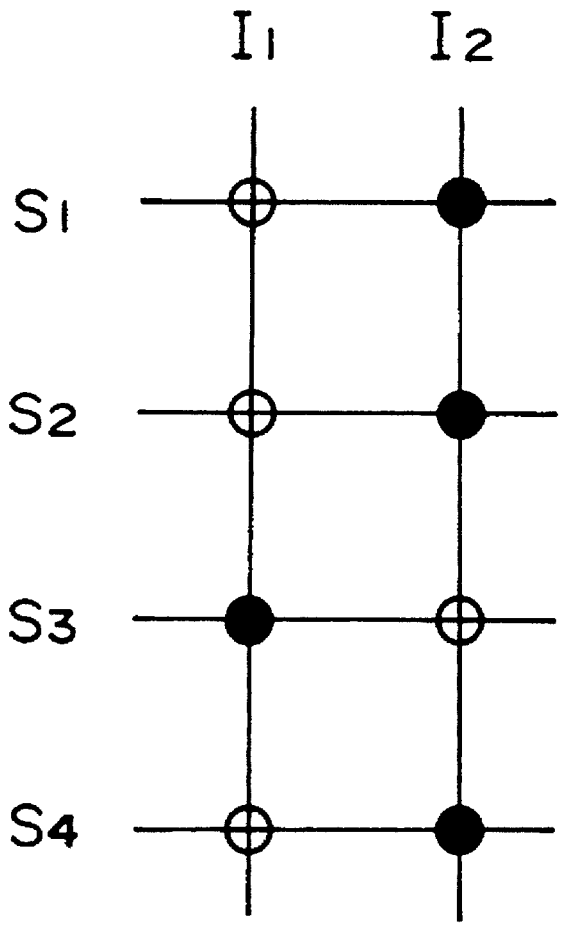
FIG. 15D is an example of a display state shown on an electrode matrix.

FIGS. 15A, 15B and 15C are time charts showing successions of driving waveforms shown in FIGS. 6A and 6B used for writing to form a display state shown in FIG. 15D. In FIG. 15D, o denotes a pixel written in white and ● denotes a pixel written in black. Further, referring to FIG. 15B, at $I_1$–$S_1$ is shown a time-serial voltage waveform applied to the intersection of a scanning electrode $S_1$ and a data electrode $I_1$. At $I_2$–$S_1$ is shown a time-serial waveform applied to the intersection of the scanning electrode $S_1$ and a data electrode $I_2$. Similarly, at $I_1$–$S_2$ is shown a time-serial voltage waveform applied to the intersection of a scanning electrode $S_2$ and the data electrode $I_1$; and at $I_{2-S2}$ is shown a time-serial voltage waveform applied to the intersection of the scanning electrode $S_2$ and the data electrode $I_2$.

The driving scheme which may be suitably adopted in the present invention is not restricted to the one described above. For example, the selection of scanning electrodes may be effected every fourth, fifth, sixth, seventh, eighth or less frequently in each field. Every eighth or less frequent scanning (i.e., scanning with seven or more electrodes apart) is preferred. Further, the scanning selection signal may be polarity-inverted for each field as shown in FIG. 14A but may also be consistent throughout a frame including plural fields or throughout a display operation.

Figure 16:
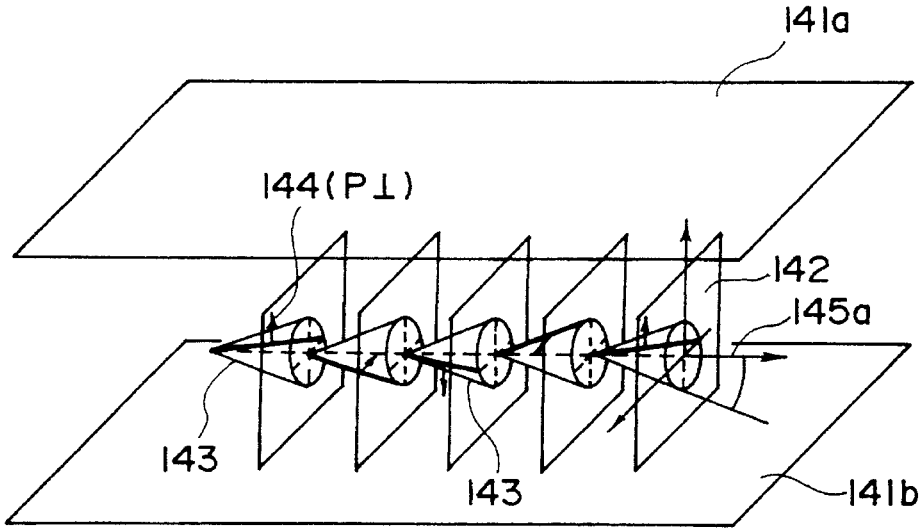
FIGS. 16 and 17 are schematic perspective views for illustrating ferroelectric liquid crystal cells used in the present invention.
Figure 17:
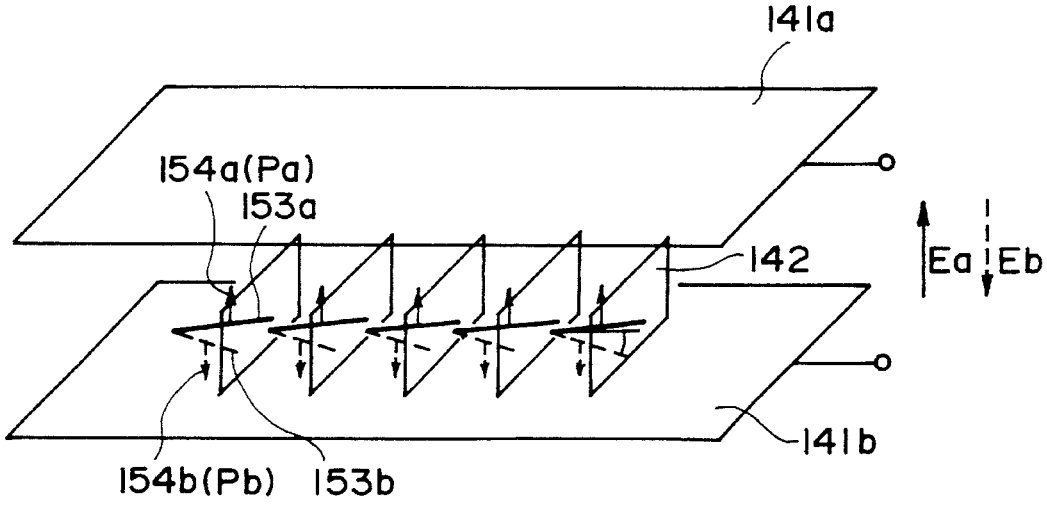

Referring to FIG. 16, there is schematically shown an example of a ferroelectric liquid crystal cell. Reference numerals 141*a* and 141*b* denote substrates (glass plates) on which a transparent electrode of, e.g., $In_2O_3$, $SnO_2$, ITO (Indium-Tin-Oxide), etc., is disposed, respectively. A liquid crystal of an SmC*-phase in which liquid crystal molecular layers 142 are oriented perpendicular to surfaces of the glass plates is hermetically disposed therebetween. A full line 143 shows liquid crystal molecules. Each liquid crystal molecule 143 has a dipole moment (P⊥) 144 in a direction perpendicular to the axis thereof. When a voltage higher than a certain threshold level is applied between electrodes formed on the base plates 141*a* and 141*b*, a helical or spiral structure of the liquid crystal molecule 143 is unwound or released to change the alignment direction of respective liquid crystal molecules 143 so that the dipole moment (P⊥) 144 are all directed in the direction of the electric field. The liquid crystal molecules 143 have an elongated shape and show refractive anisotropy between the long axis and the short axis thereof. Accordingly, it is easily understood that when, for instance, polarizers arranged in a cross nicol relationship, i.e., with their polarizing directions crossing each other, are disposed on the upper and the lower surfaces of the glass plates, the liquid crystal cell thus arranged functions as a liquid crystal optical modulation device of which optical characteristics vary depending upon the polarity of an applied voltage. Further, when the thickness of the liquid crystal cell is sufficiently thin (e.g., 1 micron), the helical structure of the liquid crystal molecules is released without application of an electric field whereby the dipole moment assumes either of the two states, i.e., Pa in an upper direction 154*a* or Pb in a lower direction 154*b*, thus providing a bistability condition, as shown in FIG. 17. When an electric field Ea or Eb higher than a certain threshold level and different from each other in polarity as shown in FIG. 17 is applied to a cell having the above-mentioned characteristics, the dipole moment is directed either in the upper direction 154*a* or in the lower direction 154*b* depending on the vector of the electric field Ea or Eb. In correspondence with this, the liquid crystal molecules are oriented to either a first orientation state 153*a* or a second orientation state 153*b*.

When the above-mentioned ferroelectric liquid crystal is used as an optical modulation element, it is possible to obtain two advantages. First is that the response speed is quite fast. Second is that the orientation of the liquid crystal shows bistability. The second advantage will be further explained, e.g., with reference to FIG. 17. When the electric field Ea is applied to the liquid crystal molecules, they are oriented in the first stable state 153*a*. This state is stably retained even if the electric field is removed. On the other hand, when the electric field Eb of which direction is opposite to that of the electric field Ea is applied thereto, the liquid crystal molecules are oriented to the second orientation state 153*b*, whereby the directions of molecules are changed. Likewise, the latter state is stably retained even if the electric field is removed. Further, as long as the magnitude of the electric field Ea or Eb being applied is not above a certain threshold value, the liquid crystal molecules are placed in the respective orientation states. In order to effectively realize high response speed and bistability, it is preferable that the thickness of the cell is as thin as possible and generally 0.5 to 20 microns, particularly 1 to 5 microns.

In the present invention, in addition to the specific driving embodiments described above, there may also be applied driving schemes as disclosed in, e.g., U.S. Pat. Nos. 4,548,476, 4,655,561, 4,697,887, 4,709,995, 4,712,872 and 4,747,671. Further, the liquid crystal panel suitably used in the present invention may be a ferroelectric liquid crystal panel as disclosed in U.S. Pat. Nos. 4,639,089, 4,674,839, 4,682,858, 4,709,994, 4,712,873, 4,712,874, 4,712,875, 4,712,877 and 4,714,323.

As described above, according to the present invention, it has become possible to suppress or remove flickering due to change in contrast occurring in a drive scheme which uses a limited region for display in order to provide an improved image quality. Further, according to the present invention, it has become possible to suppress the occurrence of flickering in a marginal display region accompanying a change in environmental temperature.

What is claimed is:

1. A display apparatus, comprising:

(a) a liquid crystal device comprising scanning electrodes, data electrodes and a ferroelectric liquid crystal disposed between said scanning electrodes and data electrodes, said scanning electrodes and data electrodes being disposed to intersect each other so as to form an electrode matrix comprising a pixel at each intersection of said scanning electrodes and said data electrodes and to provide a display surface having an effective display region including a total of M scanning electrodes for use as display-scanning electrodes and a region not displaying an image including at least one non-display-scanning electrode which has a total area larger than that of one display-scanning electrode;

(b) first means for applying a scanning selection signal to said scanning electrodes and applying data signals to said data electrodes in synchronism with the scanning selection signal;

(c) second means for controlling said first means so as to apply a scanning selection signal to said display-scanning electrodes in the display region in such a manner that a scanning selection signal is applied to said display-scanning electrodes N electrodes apart, where N: an integer of 3 or more, in one scanning operation and applied to all said M display-scanning electrodes included by the display region in N+1 times of the one scanning operation, and to apply a voltage signal pulse for providing a single display state regardless of any data signals applied through the data electrodes to said at least one non-display-scanning electrode included by the region not displaying an image so as to simultaneously cause the pixels on said at least one non-display-scanning electrode to assume the single display state in the one scanning operation during which the scanning selection signal is applied to less than M/(N+1) scanning electrodes in the display region.

2. An apparatus according to claim 1, wherein the voltage signal pulse is applied to said one scanning electrode included by the region not displaying an image in a cycle during which the scanning selection signal is applied to M/2(N+1) or less scanning electrodes in the display region.

3. An apparatus according to claim 1, wherein said one scanning electrode included by the region not displaying an image is disposed outside said scanning electrodes included by the display region and is set to have a larger width than a scanning electrode included by the display region.

4. A display apparatus according to claim 1, wherein said second means applies the voltage signal pulse to said at least one non-display-scanning electrode at least two times in the one scanning operation.

5. A display apparatus comprising:

(a) a display panel comprising scanning electrodes and data electrodes disposed to intersect said scanning electrodes so as to form a pixel at each intersection, and including a display region comprising a plurality of the pixels arranged in a plurality of rows and a plurality of columns and a marginal region not displaying an image disposed outside the display region and constituted by at least one third electrode which is disposed in parallel with said scanning electrodes, intersects with said data electrodes to form a pixel at each intersection, and has a total area larger than that of one scanning electrode;

(b) first drive means for applying a scanning selection signal to said scanning electrodes in a total number of M corresponding to the display region in such a manner that a scanning selection signal is applied to said scanning electrodes N electrodes apart, where N: an integer of 3 or more, in one scanning operation and applied to all said M electrodes in the display region in N+1 times of the one scanning operation, and applying a voltage signal for providing a single display state regardless of any data signals applied through the data electrodes to said at least one third electrode corresponding to the marginal region not displaying an image so as to simultaneously cause the pixels on said at least one third electrode to assume the single display state in the one scanning operation during which the scanning selection signal is applied to a prescribed number of less than M/(N+1) scanning electrodes in the display region;

(c) second drive means for applying data signals to said data electrodes so as to display an image in the display region and display either one of a bright state and a dark state in the marginal region not displaying an image; and (d) control means for controlling said first and second drive means so that the prescribed number of less than M is increased corresponding to an increase in environmental temperature.

6. An apparatus according to claim 5, wherein said display panel includes a liquid crystal disposed between said scanning electrodes and data electrodes.

7. An apparatus according to claim 6, wherein said liquid crystal comprises a ferroelectric liquid crystal.

8. A display apparatus comprising:

(a) a display panel comprising first electrodes and second electrodes disposed to intersect said first electrodes so as to form pixels arranged in a plurality of rows and a plurality of columns, each pixel being formed at an intersection of said first electrodes and said second electrodes;

(b) first electrode drive means for supplying a scanning signal to said first electrodes;

(c) second electrode drive means for supplying data signals to said second electrodes in synchronism with the scanning signal; and (d) control means for controlling said first electrode drive means and said second electrode drive means so that:

the pixels are divided to form a display region and a region not displaying an image outside the display region, the pixels in the region not displaying an image outside the display region having a total area which is larger than that of the pixels on one of said first electrodes, a scanning signal is applied to said first electrodes constituting the display region and a voltage signal is applied to at least one of said first electrodes constituting the region not displaying an image so as to form an image corresponding to given image data in the display region and form either one of a bright state and a dark state in the region not displaying an image, and a scanning selection signal is applied to said first electrodes in a total number of M corresponding to the display region in such a manner that a scanning selection signal is applied to said first electrodes N electrodes apart, where N: an integer of 3 or more, in one scanning operation and applied to all said M electrodes in the display region in N+1 times of the one scanning operation, and a voltage signal pulse for providing a single display state regardless of any data signals applied through the data electrodes is applied to said at least one first electrode corresponding to the region not displaying an image in the one scanning operation during which the scanning selection signal is applied to a prescribed number less than M/(N+1) first electrodes in the display region, and the voltage signal is applied to said at least one first electrode constituting the region not displaying an image each time after the scanning signal is applied to prescribed number of said first electrodes constituting the display region and the prescribed number is changed corresponding to a change in environmental temperature.

9. An apparatus according to claim 8, wherein said display panel comprises a liquid crystal disposed between said first electrodes and second electrodes.

10. An apparatus according to claim 9, wherein said liquid crystal comprises a ferroelectric liquid crystal.

11. An apparatus according to claim 8, wherein said prescribed number of said first electrodes is increased corresponding to an increase in environmental temperature.

12. A display apparatus, comprising:

(a) a liquid crystal device comprising scanning electrodes, data electrodes and a ferroelectric liquid crystal disposed between said scanning electrodes and data electrodes, said scanning electrodes and data electrodes being disposed to intersect each other so as to form an electrode matrix comprising a pixel at each intersection of said scanning electrodes and said data electrodes and to provide a display surface including said electrode matrix;

(b) first means for applying a scanning selection signal to said scanning electrodes and applying data signals to said data electrodes in synchronism with the scanning selection signal;

(c) second means for defining an effective display region including a total of M scanning electrodes and a region not displaying an image including at least one of said scanning electrodes, said at least one scanning electrodes in the region not displaying an image having a total area which is larger than that of one said M scanning electrodes in the display region; and (d) third means for controlling said first means so as to apply a scanning selection signal to said scanning electrodes in the display region in such a manner that a scanning selection signal is applied to said scanning electrodes N electrodes apart, where N: an integer of 3 or more, in one scanning operation and applied to all said M scanning electrodes included by the display region in N+1 times of the one scanning operation, and to apply a voltage signal pulse for providing a single display state regardless of any data signals applied through the data electrodes to said at least one scanning electrode included by the region not displaying an image so as to simultaneously cause the pixels on said at least one scanning electrode included by the region not displaying an image to assume the single display state in the one scanning operation during which the scanning selection signal is applied to less than M/(N+1) scanning electrodes in the display region.

* * * * *

UNITED STATES PATENT AND TRADEMARK OFFICE

CERTIFICATE OF CORRECTION

PATENT NO. : 5,526,015

DATED : June 11, 1996

INVENTOR(S) : AKIRA TSUBOYAMA ET AL.

It is certified that error appears in the above-identified patent and that said Letters Patent is hereby corrected as shown below:

COLUMN 1

Line 37, "therebetween" should read --therebetween.--.
Line 38, "and." should be deleted.

COLUMN 3

Line 3, "diagram" should read --diagrams--.

COLUMN 5

Line 13, "With" should read --Width--.

COLUMN 8

Line 47, "be" should be deleted.

COLUMN 9

Line 5, "parts P40" should read --ports P40--.

COLUMN 10

Line 43, "ill" should read --in--.

COLUMN 15

Line 28, "Date" should read --Data--.

UNITED STATES PATENT AND TRADEMARK OFFICE

CERTIFICATE OF CORRECTION

PATENT NO. : 5,526,015

DATED : June 11, 1996

INVENTOR(S) : AKIRA TSUBOYAMA ET AL.

It is certified that error appears in the above-identified patent and that said Letters Patent is hereby corrected as shown below:

COLUMN 16

Line 61, "S4n-1" should read --$S_{4n-1}$--.
Line 64, "$F_4$M-3" should read --$F_{4M-3}$--.

COLUMN 17

Line 16, "$F_{4M-}3$" should read --$F_{4M-3}$--.

COLUMN 18

Line 28, "$I_{2-S2}$" should read --$I_2$-$S_2$--.
Line 56, "are" should read --is--.

COLUMN 20

Line 4, "signal;" should read --signal; and--.

Signed and Sealed this

Fifth Day of November, 1996

Bruce Lehman

*Attest:*

BRUCE LEHMAN

*Attesting Officer*

*Commissioner of Patents and Trademarks*